US007124481B2

(12) United States Patent
Sato et al.

(10) Patent No.: US 7,124,481 B2
(45) Date of Patent: Oct. 24, 2006

(54) BUCKLE DEVICE

(75) Inventors: Akira Sato, Osaka (JP); Naohiro Yamada, Kyoto (JP)

(73) Assignee: Ashimori Industry Co. Ltd., Osaka (JP)

( * ) Notice: Subject to any disclaimer, the term of this patent is extended or adjusted under 35 U.S.C. 154(b) by 0 days.

(21) Appl. No.: 10/740,905

(22) Filed: Dec. 19, 2003

(65) Prior Publication Data

US 2004/0163224 A1 Aug. 26, 2004

Related U.S. Application Data

(62) Division of application No. 10/049,400, filed as application No. PCT/JP00/05435 on Aug. 14, 2000, now Pat. No. 6,701,587.

(30) Foreign Application Priority Data

Aug. 13, 1999 (JP) ..... 11-229501
Aug. 13, 1999 (JP) ..... 11-229502

(51) Int. Cl.
*A44B 11/26* (2006.01)

(52) U.S. Cl. ..... 24/641; 24/636; 24/642

(58) Field of Classification Search ..... 24/633, 24/641, 642, 636, 647
See application file for complete search history.

(56) References Cited

U.S. PATENT DOCUMENTS 4,182,008 A 1/1980 Pouget
4,388,746 A 6/1983 Krautz et al.
4,393,557 A 7/1983 Schmidt
4,624,034 A * 11/1986 Ishiguro et al. ..... 24/641
4,670,952 A * 6/1987 Ishiguro ..... 24/641
4,703,542 A 11/1987 Hirata et al.
5,054,171 A 10/1991 Tanaka
5,121,528 A * 6/1992 Tanaka ..... 24/641
5,159,732 A 11/1992 Burke
5,163,207 A 11/1992 Krautz et al.
5,584,108 A 12/1996 Pleyer
5,704,099 A 1/1998 Cahill (Continued)

FOREIGN PATENT DOCUMENTS

EP 0 368 277 A1 5/1990

(Continued)

OTHER PUBLICATIONS

European Search Report from corresponding European Application No. 00 95 1979.4.

*Primary Examiner*—Robert J. Sandy
(74) *Attorney, Agent, or Firm*—Wolf, Greenfield & Sacks, P.C.

(57) ABSTRACT

A buckle device capable of reducing an impact noise generated when a tongue plate (2) is inserted and eliminating a coil spring member energizing a release button (50) and a lock pin holder so as to simplify a structure, wherein a lock bar (30) has both end parts inserted into slots (16) and is mounted on a pair of side plate parts (12), both end parts of the lock bar (30) are engaged with a pair of guide grooves (54) in a pair of guide wall parts (52) of a synthetic resin release button (50) and, when the tongue plate (2) is inserted, the lock bar (30) is moved rapidly to the front end part of the slots (16) and, in this case, the end parts of the lock bar (30) are supported on a supporting part (55) at the end of the guide groove (54), not on the end of the slots (16).

10 Claims, 15 Drawing Sheets

U.S. PATENT DOCUMENTS

| | | | | |
|---|---|---|---|---|
| 5,722,129 | A | 3/1998 | Harrison et al. | |
| 5,742,987 | A | 4/1998 | Mikulec et al. | |
| 5,784,766 | A | 7/1998 | Downie et al. | |
| 6,292,988 | B1 * | 9/2001 | Jackson et al. | 24/641 |
| 6,438,810 | B1 * | 8/2002 | Rogers et al. | 24/641 |

FOREIGN PATENT DOCUMENTS

| | | | |
|---|---|---|---|
| EP | 1 018 307 | A1 | 7/2000 |
| JP | 4-58963 | A | 2/1992 |
| JP | 5-74308 | U | 10/1993 |
| JP | 6-66311 | U | 9/1994 |
| JP | 6-66315 | U | 9/1994 |
| JP | 11-155611 | A | 6/1999 |

* cited by examiner

BUCKLE DEVICE

RELATED APPLICATIONS

This application is a divisional application of U.S. patent application Ser. No.: 10/049,400, filed Jun. 7, 2002, now U.S. Pat. No. 6,701,587 which is the National Stage of International Application No. PCT/JP00/05435, filed Aug. 14, 2000, each of which are herein incorporated by reference in their respective entireties.

TECHNICAL FIELD

The present invention relates to a buckle device for use in seat belts of motor vehicles, and particularly relates to a buckle device in which impact noises between metal members upon insertion of a tongue plate are reduced and of which structure is simplified. The present invention further relates to a buckle device including a buckle body and a tongue plate, and particularly relates to a buckle device which has an improved structure to prevent detachment of the tongue plate from the buckle body in an emergency of the vehicle, and to a buckle device which is configured to prevent detachment of the tongue plate from the buckle body, when the buckle body is moved in the tightening direction of the webbing by a pretensioner in an emergency of the vehicle.

BACKGROUND ART

Conventionally, a seat belt device mounted on a vehicle is provided with a buckle device which comprises a tongue plate movably attached to the intermediate part of a webbing and a buckle body into and from which the tongue plate is inserted and retracted. This buckle device allows the webbing worn by the occupant to be releasably secured to the vehicle body with ease and reliability.

As described in JP, U, 6-66315, a buckle device is comprised of a metal frame, a hook member which is mounted on or supported by the frame pivotably or swingably and which is engageble with and disengageable from a tongue plate, a lock pin made of metal to lock and unlock the pivotal motion of the hook member, a lock pin holder to hold the lock pin, and a biasing member to urge the lock pin via the lock pin holder, an ejector, a spring member to urge the ejector, a release button which is urged by a coil spring in the same direction as that of withdrawal of the tongue plate to disengage the tongue plate, a base cover and lid cover made of plastics, and so forth.

The foregoing frame includes a base plate part and a pair of side plate parts rising from the base plate part, and the pair of side plate parts are formed with a pair of long holes, and a lock pin is passed through the pair of long holes and mounted across the pair of side plate parts. When inserting the tongue plate, the hook member is made to pivot by the tongue plate via the ejector and comes into engagement with tongue plate, and the lock pin is moved to a first position by the urging force of a biasing member to inhibit the pivoting of the hook member to the disengaging side thereby holding the tongue plate and hook member in an engaged state. The foregoing hook member is pivotally urged in the disengaging direction all the time, and when detaching the tongue plate by releasing the engagement between the tongue plate and the hook member, the hook member is made to pivot to the disengage side by switching the lock pin from a first position to a second position by depressing the release button made of plastics, and thus the tongue plate is made detachable.

The buckle device of JP, U, 6-66311 has a basic configuration comprising a buckle body, a hook member which is pivotally supported by the buckle body and is switchable between engaged and disengaged states with respect to the tongue plate, a lock pin which is supported by the buckle body and is movable between a first position to hold the hook member in engaged state, and a second position to disengage the hook member, a release button which is urged toward the withdrawal direction of the tongue plate by a coil spring, and so forth.

Moreover, in the buckle device of this publication, a lock lever is pivotably mounted near the lock pin to cope with a case in which a pretensioner is equipped to retract the buckle body to the tightening direction to tighten the webbing in an emergency of the vehicle. When inserting the tongue plate, the lock pin is moved to and held in the first position by the lock lever which is pivotally urged by a biasing member, and when detaching the tongue plate, the lock lever is forced to pivot to the non-locked position allowing the lock pin to move to the second position.

Furthermore, near the lock lever is provided a plate-like inertial body which is supported and guided to be movable closing to and away from the lock lever and is constantly urged by a spring member in the direction to move away from the lock lever.

When a buckle body comes into an abrupt stop after it is retracted in the tightening direction of the webbing by a pretensioner which operates in an emergency of the vehicle, the inertial body is moved to lock lever side by an inertial force against the urging force of the spring member and is brought into contact with the lock lever thereby preventing the lock lever from pivoting to the non-lock position. Thus arrangement is made to prevent the detachment of tongue plate from the buckle body, which occurs when the lock pin causes the lock lever to pivot to the non-lock position thereby disengaging the hook member.

The buckle device according to JP, A, 4-58963, comprises a latch member which can come into and out of engagement with a tongue plate, an operation member to release the engagement of the latch member, a lock member which moves to a release position in response to operation of an operational member to disengage the latch member, and a lock mechanism which can prevent disengagement of the latch member. An arrangement is made such that the lock mechanism is provided with a motion restriction member which is pivotably mounted on an operation member and partly protrudes into the movable area of the lock member, and when an impact occurs, the moving lock member comes into abutment with the motion restriction member while part of the motion restriction member, which is pivoting, is in the movable area, and thus the movement of the lock member to the release position is arrested.

DISCLOSURE OF THE INVENTION

The buckle device described in JP, U, 6-66315 has a problem in that upon inserting the tongue plate, a sharp impact noise is generated by a collision between the metal lock pin and the metal frame when the lock pin is moved to the first position by the urging force of a biasing member and is received by the ends of the pair of long holes.

Moreover, in this buckle device, since a pin member like a round bar is used as the lock pin, a plastic lock pin holder with a complex structure needs to be provided to hold the lock pin, and thereby the number of parts is increased, the structure becomes more complicated, and also assembly of the buckle device becomes inconvenient.

This buckle device is provided with a coil spring member for urging the release button in the same direction as the detachment direction of the tongue plate in addition to a spring member for urging the ejector in the detachment direction of the tongue plate, and therefore a pair of spring receiving parts to receive the coil spring member as well as the coil spring member need to be provided, and thereby the number of parts is increased, the structure becomes complicated, and also the assembly of the buckle device becomes inconvenient.

Furthermore, in the buckle device described in JP, U, 6-66311, a lock lever and an inertial body are provided so that when the buckle body comes to a sudden stop after being retracted by a pretensioner in an emergency of the vehicle, the inertial body is moved to the lock lever side by an inertial force and is brought into contact with the lock lever thereby inhibiting the lock lever from pivoting to the non-locked position and holding the lock pin in the first position. However, when the buckle body comes to a sudden stop, an inertial force acts on the lock pin as well, and since the lock pin is received directly by the lock lever, a large force is exerted on the lock lever by the lock pin.

Therefore, there is a risk that the lock pin or lock lever or the like may be broken or deformed and thereby the lock pin is moved to the second position thus losing its normal function. To ensure that this will not happen, a lock pin and a lock lever and the like with higher rigidity, therefore of higher cost, need to be used thus leading to a disadvantageous production cost.

Moreover, to prevent the tongue plate from getting detached from the buckle body due to operation of the pretensioner, the lock lever, the inertial body, and urge members to urge these members respectively need to be provided. This would increase the number of parts and make the structure more complex, and assembly of buckle device will become complex thus leading to a disadvantageous production cost. In addition, when inserting the tongue plate, the lock lever pushes the lock pin to the first position and an inclined part of the lock lever, which is pivoting, comes into contact with the lock pin transmitting a force, therefore the insertion operation of the tongue plate may not be smoothly conducted.

Furthermore, in the buckle device described in JP, U, 6-66311, when the inertial body moves to the lock lever side upon a sudden stop of the buckle body, the lock pin may move very fast to the second position since the whole inertial force acting on the lock pin acts to move the lock pin to the second position. That is, since the lock lever may pivot very fast to the non-locked position side, the inertial body, which starts moving upon a sudden stop of the buckle body, may not contact with the lock lever appropriately and thus there is a high possibility that the lock lever is not prevented from pivoting to the non-locked position.

In the buckle device of JP, A, 4-58963, in a normal state, a part of a motion restriction member intervenes into the motion track of a lock member however, since the moving restriction member also pivots due to a collision of the vehicle, the lock member may not abut with the motion restriction member while a part of the motion restriction member stays in the foregoing motion area. If this happens, the latch member will become disengaged thereby causing the tongue plate to be detached.

Therefore the object of the present invention includes: reducing the impact noise between a lock pin and a frame during insertion of a tongue plate, simplifying the structure by eliminating a coil spring member for urging the foregoing release button, simplifying the structure by eliminating the lock pin holder, and so forth.

It is another object of the present invention to provide a buckle device including a tongue plate and a buckle body, in which detachment of the tongue plate from the buckle body in an emergency of the vehicle is reliably prevented, a smooth and secure insertion and detachment operation of the tongue plate is achieved in a normal state, and the structure for preventing the detachment of the tongue plate from the buckle body in an emergency of the vehicle is simplified, and so forth.

It is a further object of the present invention to provide a buckle device including a pretensioner for retracting the buckle body to the tightening side, in which detachment of the tongue plate from the buckle body due to an operation of the pretensioner is reliably prevented, and the structure for preventing detachment of the tongue plate from the buckle body due to an operation of the pretensioner is simplified, and so forth.

Thus, according to the first invention of the present application, there is provided a buckle device, comprised of a tongue plate to be connected to a webbing and a buckle body into and from which the tongue plate is inserted and extracted, wherein the buckle body comprises: a frame; a hook member pivotably mounted on the frame, the hook member adapted to pivot to engage with the tongue plate upon insertion of the tongue plate and urged to pivot to the disengaging direction all the time; a lease button made of plastics and for releasing the engagement between the hook member and the tongue plate; and a lock bar adapted to move to a first position to inhibit the pivoting of the hook member in the disengaging direction by urging force of a biasing member when tongue plate is in engagement with the tongue plate, and to move to a second position to allow the pivoting of the hook member in the disengaging direction by being pressed by the release button during disengaging operation of the release button, and wherein a stop restricting member, adapted to receive the lock bar against the urging force of the biasing member when the lock bar is moved to the first position by the urging force, is integrally formed with the release button.

In the buckle device described above, when inserting the tongue plate into the buckle body, the hook member is made to pivot to engage with the tongue plate along with the insertion of the tongue plate, and the lock bar is switched from the second position to the first position by the urging force of the biasing member thereby inhibiting the pivoting of hook member in the disengaging direction. When detaching the tongue plate, the lock bar is switched from the first position to the second position and the hook member is made to pivot in the disengaging direction to be disengaged from the tongue plate upon disengaging operating the release button, and thus the tongue plate becomes ready to be detached.

On the other hand, when inserting the tongue plate, the stop restriction part, which receives the lock bar against the urging force of the biasing member when the lock bar is moved from the second position to the first position by the urging force, is formed integrally with the release button, and therefore the lock bar is received by the stop restriction part made of plastics when it is switched from the second position to the first position; thus there is no impact noise between a couple of metal members produced and only quieter and milder impact noise than that of metal members is produced.

The buckle device described above may be configured such that: the buckle body comprises an ejector which is pushed by the tongue plate thereby making the hook member pivot in the engaging direction when inserting the tongue plate, and a spring member for urging the ejector toward the disengaging direction of the tongue plate; and when detaching the tongue plate, the ejector is made to abut against the release button and push it in the detaching direction of the tongue plate.

When inserting the tongue plate, pushing the ejector with the tongue plate causes the hook member to pivot in the engaging direction, and thus the tongue plate and the hook member are brought into engagement.

This ejector is urged in the detaching direction of the tongue plate by a spring member and therefore, when the tongue plate is detached, the ejector comes into abutment with the release button by the urging force of the spring member and pushes it in the detaching direction of the tongue plate. In this way, since the release button is pushed in the detaching direction of the tongue plate by exploiting the spring member for urging the ejector, the spring member for pushing the release button in the detaching direction of the tongue plate can be eliminated, and the spring receiving parts to receive the both ends of the spring member can also be eliminated.

Moreover, the buckle device described above may be configured such that: the frame comprises a base plate part, a pair of opposing side plate parts which rise from the base plate part, and a pair of long holes formed in the side plate parts; the above described lock bar is passed through the pair of long holes and mounted across the pair of side plate parts; and the above described stop restriction part is comprised of a pair of receiving parts which receive the both ends of the lock bar projecting outwardly from the pair of side plate parts. In this way, since the lock bar is passed through a pair of long holes and mounted across the pair of side plate parts of the frame, the support of the both ends of the lock bar is stabilized, and thereby the pivoting of the hook member in the disengaging direction is securely inhibited when the lock bar is in the first position. Also since the above described stop restricting part is comprised of a pair of receiving parts which receive the both ends of the lock bar protruding outwardly from the pair of side plate parts, operational stability when receiving the lock bar in the first position is secured.

Furthermore, the foregoing buckle device may include a stopper part which is integrally formed on the frame, and which engages the release button against the urging force of the above described biasing member for urging the above described lock lever.

Upon insertion of the tongue plate, when the lock bar is switched from the second position to the first position by the urging force of the biasing member and is received by the stop restriction part which is integrally formed with the release button, the release button is subjected to an urging force of the lock bar in the detaching direction of the tongue plate, but the release button can be securely kept engaged by the stopper part integrally formed on the frame.

Further, the above described buckle device may be configured such that: the above described lock bar is formed of a strip-type member; the above described release button includes a pair of guide wall parts each of which is closely located outside the above described pair of side plate parts; and the guide wall parts are formed with a pair of guide grooves for guiding the both ends of the lock bar which project from the pair of the side plate parts respectively.

The above described lock bar is formed of a strip-type member, and its both ends are passed through a pair of long holes and guided by a pair of guide grooves, therefore the release button can be movably guided by the both ends of the lock bar via the pair of guide grooves.

A pair of guide wall parts and the guide grooves thereon restrain the lock bar from moving in its longitudinal direction and coming out of the pair of long holes of the frame. The frame, the pair of long holes, and the lock lever restrain the release button from being disengaged from the lock bar and restrict the moving direction of the release button. Thus, the structures relating to the lock bar and the release button are greatly simplified.

Furthermore, the above described buckle device may be configured such that each guide groove is formed of a groove with its both ends closed, and each guide wall part is formed with an import opening part for introducing the end of the lock bar into intermediate part of the length of the guide groove from the direction perpendicular to the guide groove.

Therefore, during the assembly of the buckle device, the release button can readily be assembled by introducing the end of the lock bar into the intermediate part of the length of the guide groove through the import opening part. Moreover, it is possible to minimize the chance that the lock bar comes off the import opening part by forming the import opening part in an appropriate position which does not correspond to the positions of the lock bar when it is in the first or second position.

According to the second invention of the present application, there is provided a buckle device including a tongue plate to be connected to a webbing and a buckle body to and from which the tongue plate is inserted and extracted, wherein the buckle body comprises: a frame; a hook member pivotably mounted on the frame, the hook member adapted to pivot to engage with the tongue plate upon insertion of the tongue plate and urged pivotally in the disengaging direction all the time; a release button for releasing the engagement between the hook member and the tongue plate; and a lock bar adapted to move to a first position, in which the lock bar inhibits pivoting of the hook member in the disengaging direction, by an urging force of a biasing member when being engaged with the tongue plate, and to move to a second position, in which the lock bar allows pivoting of the hook member in the disengagement direction, by being pushed by the release button upon disengaging operation of the release button. The buckle device is further provided with a lock member which is mounted on said frame pivotably between a lock position, in which the lock bar is locked in the first position, and a non-lock position in which the lock bar is not locked; and a biasing member for elastically urging the lock member to the non-lock side, wherein the lock member comprises a base end part pivotally mounted on the frame, a first engaging part formed in its one end, and a second engaging part which faces the first engaging part keeping a space to allow for reception of the lock bar, wherein the first position side end part of the lock bar abuts with the first engaging part maintaining the lock position, and the second engaging part protrudes into the movable area of the lock bar closely facing the lock bar in a state that the lock member rests in the lock position.

When inserting the tongue plate into the buckle body, the hook member is caused to pivot to engage with the tongue plate as the tongue plate is inserted, and the lock bar is switched from the second position to the first position by the urging force of the biasing member, thus inhibiting the pivoting of the hook member in the disengaging direction. The lock member is pivotably mounted on the frame at its base end, and in normal conditions, is elastically urged to the non-lock position by the biasing member. Therefore, when the lock bar moves from the second position to the first position, the lock bar does not interfere with the second engaging part and the first position side end part of the lock bar abuts with the first engaging part thereby causing the lock member to pivot to the lock position. When the lock bar moves to the first position, the lock member settles in the lock position and the lock bar is received between the first and second engaging parts, in which state, the first position side end part of the lock bar abuts the first engaging part thereby maintaining the lock position, and the second engaging part protrudes into the moving area of the lock bar closely facing the lock bar.

On the other hand, when detaching the tongue plate from the buckle body, the lock bar is switched from the first position to the second position upon disengaging operation of the release button; this causes the hook member, which is pivotally urged, to pivot in the disengaging direction to be disengaged from the tongue plate, and thus the tongue plate becomes ready to be detached. When the tongue plate is being inserted, the second engagement part protrudes into the moving area of the lock bar closely facing the lock bar, but when the lock bar starts moving from the first position to the second position, immediately after that moment, the lock bar comes out of abutment from the first engagement part and the lock member, which is urged by the biasing member, and pivots to the non-lock side. Since the switching of the lock bar from the first position to the second position is manually operated and therefore is not very fast, the lock bar moves to the second position without coming into contact with the second engaging part after the lock member has pivoted to the non-lock position.

When the lock bar is subjected to an inertial force in the direction of the first position in an emergency of the vehicle, the lock bar pushes the lock member holding it securely in the locked position with the inertial force in addition to the urging force of the biasing member. On the other hand, when the lock bar is subjected to an inertial force in the direction of the second position, the lock bar starts moving to the second position side.

As described above, in a state that the tongue plate is being inserted in the buckle body, the first position side end part of the lock bar abuts the first engaging part maintaining the lock position, and the second engaging part protrudes into the moving area of the lock bar closely facing the lock bar; therefore the second engaging part receives the lock bar, which has started moving to the second position side, inhibiting the lock bar from moving to the second position. Thus it is made possible to securely prevent the detachment of the tongue plate from the buckle body due to disengagement of the hook member.

The above described function is effective either in a case where an inertial force to the first position is applied to the lock bar due to an impact force in an emergency of the vehicle, or in a case where a pretensioner is equipped so as to retract the buckle body to the tightening side to tighten the webbing in an emergency of the vehicle, and an inertial force to the second position is applied upon operation of the pretensioner, or upon abrupt stop of the buckle body after operation of the pretensioner.

Furthermore, in a normal vehicle collision, the engagement between the hook member and the tongue plate may be released when the hand or elbow of the vehicle occupant accidentally touches the release button of the buckle device due to a sudden change in the posture of the occupant.

However, according to the present application, even if the release button is depressed in the above mentioned situation, the lock member inhibits the movement of the lock bar in the disengaging direction (the second position). That is, since there occurs a delay in the operation of the lock member relative to rapid movement of the lock bar, the lock bar stays in a state in which it inhibits the pivoting of the hook member in the disengaging direction and thus disengagement of the hook member and the tongue plate is prevented.

In the above described buckle device, the base end part of the lock member may be pivoted on the frame at a position spaced away from the plane including the moving area of the lock bar in the direction opposite the hook member.

Thus, the first position side end part of the lock bar, which is moving to the first position, pushes the first engaging part and thereby securely causing the lock member to pivot to the lock position and holding it in the lock position.

In the second invention of the present application, the buckle device may be configured as follows: A buckle device, having a tongue plate to be connected to a webbing and a buckle body to and from which the tongue plate is inserted and extracted, and comprising a pretensioner adapted to retract the buckle body in the tightening direction of the webbing to tighten the webbing in an emergency of the vehicle; wherein the buckle body comprises: a frame; a hook member pivotably mounted on the frame, the hook member adapted to pivot to engage with the tongue plate upon insertion of the tongue plate and being pivotally urged in the disengaging direction all the time; a release button for releasing the engagement between the hook member and the tongue plate; and a lock bar adapted to move to a first position, in which the lock bar inhibits pivoting of the hook member in the disengaging direction, by an urging force of a biasing member when being engaged with the tongue plate, and to move to a second position, in which the lock bar allows pivoting of the hook member in the disengagement direction, by being pushed by the release button upon disengaging operation of the release button. The buckle device is further provided with a lock member mounted on said frame pivotably between a lock position, in which the lock bar is locked in the first position, and a non-lock position in which the lock bar is not locked, and a biasing member for elastically urging the lock member to the non-lock side; wherein the lock member includes a first engaging part with which the first position side end part of the lock bar can abut and a second engaging part which protrudes into the movable area of the lock bar and with which the second position side end part of the lock bar can abut; and wherein the lock bar, which is urged to the first position, abuts the first engaging part causing the lock member to pivot to the lock position, and the lock bar, which has started moving toward the second position due to an inertial force generated upon a sudden stop of the buckle body after an operation of the pretensioner, is received by the second engaging part, thus the movement of the lock bar to the second position is inhibited either when the pretensioner is in operation or when not in operation.

During a normal state in which the pretensioner is not in operation, in a situation where the tongue plate is being inserted in the buckle body, the first position side end part of the lock bar abuts the first engaging part causing the lock member to pivot to and to be held in the lock position. In this state, the second engaging part protrudes into the movable area of the lock bar, and upon operation of the pretensioner in an emergency of the vehicle, the buckle body is retracted in the webbing tightening direction and then comes into an abrupt stop generating, firstly, an inertial force which acts on the lock bar in the direction to the first position immediately after the buckle body has started moving. At this time, the lock bar pushes the lock member with the inertial force in addition to the urging force thereby maintaining the lock member securely in the lock position.

On the other hand, upon an abrupt stop of the buckle body, the lock bar starts moving toward the second position side under an inertial force.

In a state in which the tongue plate is being inserted in the buckle body, as described above, since the lock member is held in the lock position and the second engaging part protrudes into the movable area of the lock bar, the second engaging part receives the lock bar which has started moving toward the second position inhibiting the movement of the lock bar to the second position, and thus it is possible to securely inhibit the detachment of the tongue plate from the buckle body. Other functions except the one in an emergency of the vehicle are generally the same as described before.

The buckle device according to the second invention may be configured such that the above described lock member is pivotably mounted on the frame via a pivot part which is off-centered from the center of gravity of the lock member so that an inertial force acts on the lock member causing it to pivot to the lock position side upon a sudden stop of the buckle body after operation of the pretensioner.

That is, upon a sudden stop of the buckle body, since the lock member is securely held in the lock position, it is made possible to securely receive the lock bar, which has started moving toward the second position, with the second engaging part.

At this time, the weights of the lock member and lock bar, urging force of the biasing member, and the pivot position of the lock member may be determined so that the lock member can be suppressed by the lock bar and held in the lock position upon a sudden stop of the buckle body after an operation of the pretensioner.

Furthermore, the buckle device according to the second invention may be configured such that the second engaging part of the lock member exerts a pivoting force on the lock member to pivot to the lock position side upon coming into contact with the lock bar which is moving to the second position side.

Therefore, even when the second engaging part of the lock member has not fully intervened into the movable area of the lock bar, it is possible to make the lock member pivot to the lock position when the lock bar, which started moving to the second position side, comes into contact with the second engaging part. Thus, it is made possible to make the second engaging part fully intervene into the movable area of the lock bar, and thereby have the lock bar securely received by the second engaging part.

Next, according to the third invention of the present application, there is provided a buckle device; including a tongue plate to be connected to a webbing and a buckle body into and from which the tongue plate is inserted and extracted, and equipped with a pretensioner adapted to retract the buckle body in the tightening direction to tighten the webbing in an emergency of the vehicle; wherein the buckle body comprises: a frame; a hook member pivotably mounted on the frame and adapted to pivot to engage with the tongue plate upon insertion of the tongue plate and being pivotally urged in the disengaging direction all the time; a release button to release the engagement between the hook member and the tongue plate; a lock bar adapted to move to the first position to inhibit the pivoting of the hook member in the disengaging direction by an urging force of an biasing member, and to move to the second position to allow pivoting of the hook member in the disengaging direction by being pushed by the release button upon disengaging operation of the release button. The buckle device is further provided with a lock lever which is pivotable between a lock position to lock the hook member, which is in engagement with the tongue plate, to be unable to be disengaged and a non-lock position to allow disengagement, and which is urged to the non-lock position all the time, wherein the lock lever is pivotably mounted on the frame via a pivot part which is off-centered from the center of gravity of the lock lever, and upon operation of the pretensioner, the lock lever pivots to the lock position urged by an inertial force just after the buckle body has started moving, and the lock bar moves to the second position urged by an inertial force when the buckle body abruptly stops, thus the pivoting of the lock lever from the lock position to the non-lock position is inhibited.

When inserting the tongue plate into the buckle body, the hook member pivots and come into engagement with tongue plate as the tongue plate is inserted, and then the lock bar is moved from the second position to the first position by the urging force of the biasing member and inhibits the pivoting of the hook member in the disengaging direction. When detaching the tongue plate, upon disengaging operation of the release button, the lock bar is moved from the first position to the second position and thereby the hook member, which is pivotally urged, pivots in the disengaging direction to disengaging the tongue plate, thus the tongue plate becomes ready to be detached.

In a normal state in which the pretensioner is not in operation, the lock lever is urged to the non-lock position all the time. In an emergency of the vehicle, the pretensioner operates and the buckle body is retracted in the tightening direction of the webbing and then stops abruptly. At this time, first the lock lever pivots to the lock position urged by an inertial force immediately after the buckle body has started moving, then the lock bar moves to the second position urged by an inertial force when the buck abruptly stops, and thus the lock bar inhibits the pivoting of the lock lever from the lock position to the non-lock position. After operation of the pretensioner, the lock bar returns to the first position urged by the biasing member, and thereby the lock lever is urged to pivot to the non-lock position returning to a normal state.

Thus, if the lock lever is not provided, the lock bar undergoes an inertial force thereby moving from the first position to the second position, and the hook member is disengaged and thus the tongue plate may be detached from the buckle body. But with a lock lever being provided, even if the lock bar moves to the second position, the lock bar inhibits the pivoting of the lock lever from the lock position to the non-lock position, thus it is made possible to securely prevent the detachment of the tongue plate from the buckle body.

Moreover, detachment of the tongue plate from the buckle body due to operation of the pretensioner can be prevented by a simple structure comprised of a lock lever and so forth, thereby resulting in an advantageous production cost. Furthermore, when the lock bar is moved to the second position by an inertial force upon an abrupt stop of the buckle body, the lock bar is received resiliently by a biasing member thereby allowing normal operation without being broken or deformed.

The above described buckle device may be configured such that the lock lever is provided with a contact part at its tip part so that the lock bar, which has moved to the second position upon an abrupt stop of the buckle body, comes into contact with the contact part thereby holding the lock lever in the lock position. That is, the lock bar, which has moved to the second position, comes into contact with the contact part of the lock lever upon abrupt stop of the buckle body thereby holding the lock lever in the lock position, and thus it is made possible to securely inhibit the pivoting of the lock lever to the non-lock position.

In the above described buckle device, the lock lever may have an inclined guiding part which undergoes a pivoting force toward the lock position exerted by the lock bar which is moving to the second position.

That is, when the lock lever is about to move from the lock position to the non-lock position, the lock, bar which is moving to the second position, comes into contact with the inclined guiding part of the lock lever thereby urging the lock lever to pivot to the lock position side, and thus it is made possible to have the lock lever forcibly pivot to and held in the lock position.

In the above described buckle device, the center of gravity of the lock lever is preferably disposed such that the lock lever is pivoted toward the lock position by the inertial force which acts on the center of gravity of the lock lever upon movement of the buckle body. That is, it is possible to have the lock lever securely pivoted to the lock position by an inertial force which acts on the lock lever just after the buckle body has started moving.

Furthermore, the above described buckle device may be configured such that, the lock lever comprises a first and second levers which are pivotable about a common axis, wherein the first lever pivots urged by an inertial force just after the buckle body has started moving, and the second lever is pushed by the first lever to pivot to the lock position, and the second lever is held in the lock position side by an inertial force when the buckle body comes into an abrupt stop.

In this buckle device, the second lever is pushed to pivot to the lock position by the first lever which is pivoted by an inertial force just after the buckle body has started moving, and then the second lever is held in the lock position side by an inertial force when the buckle body comes into an abrupt stop. That is, when the buckle body stops abruptly, the lock bar moves to the second position thereby restraining the second lever from pivoting from the lock position to the non-lock position more securely, and thus it is possible to securely prevent the detachment of the tongue plate from the buckle body.

DESCRIPTION OF THE SYMBOLS

Figure 1:
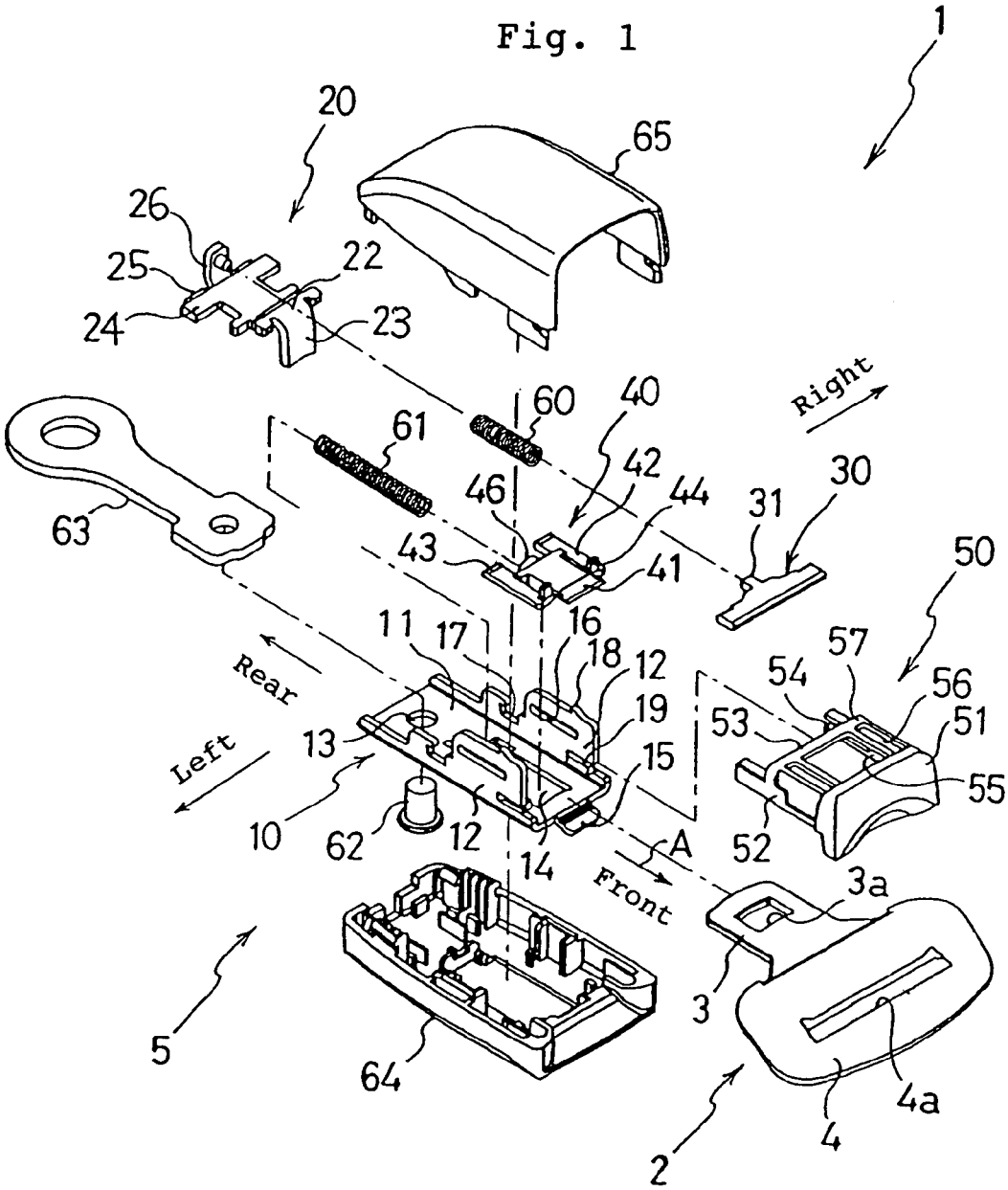
FIG. 1 is an exploded perspective view showing an embodiment of the buckle device according to the first invention of the present application.

1, 1A buckle device
2 tongue plate
5 buckle body
10 frame
16 long hole
18 stopper part
20 hook member
30 lock bar
40 ejector
43 operating part
44 pushing part
50 release button
52 guiding part
54, 54A guide groove
54*a* import opening part
55 receiving part
57 engaged part
60,61,70,71 coil spring
80 first lever
86 second lever
90 lock member
93 first engaging part
94 second engaging part
96, 105 torsion spring
100 lock lever
102*b*, 87*b* contact part
102*c*, 87*c* inclined guide part
104 axial member
110 spring mounting hole

MODES FOR CARRYING OUT THE INVENTION

The embodiments of the first invention of the present application will be described referring to the drawings.

A seat belt apparatus of a vehicle is equipped with a buckle device for connecting a webbing worn by the occupant to the vehicle body. By way of explanation, the buckle device 1 shown in FIGS. 1 to 7 will be explained by defining the four directions: forward/rearward and rightward/leftward as shown in FIG. 1 where arrow A denotes the forward direction. The buckle device 1 basically consists of a tongue plate 2 which is movably attached to intermediate part of the webbing (not shown) and a buckle body 5, and the front end part of the buckle body 5 is provided with an insert port 6 for inserting the tongue plate 2. The tongue plate 2 has a tongue part 3 made of metal and to be inserted into the buckle body 5 and a tongue body part 4 integrally formed with the tongue part 3 and covered with a plastic material, and the tongue part 3 is formed with a rectangular engaging hole 3*a*, and the tongue body part 4 is formed with a rectangular passage hole 4*a*.

Figure 2:
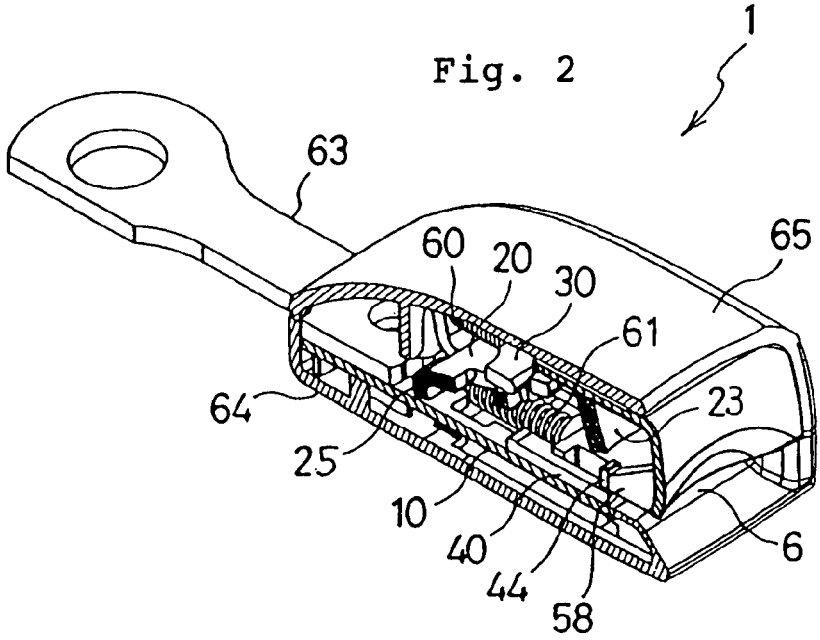
FIG. 2 is a partial cutaway and longitudinally sectioned perspective view showing the buckle device according to the first invention of the present application.
Figure 3:
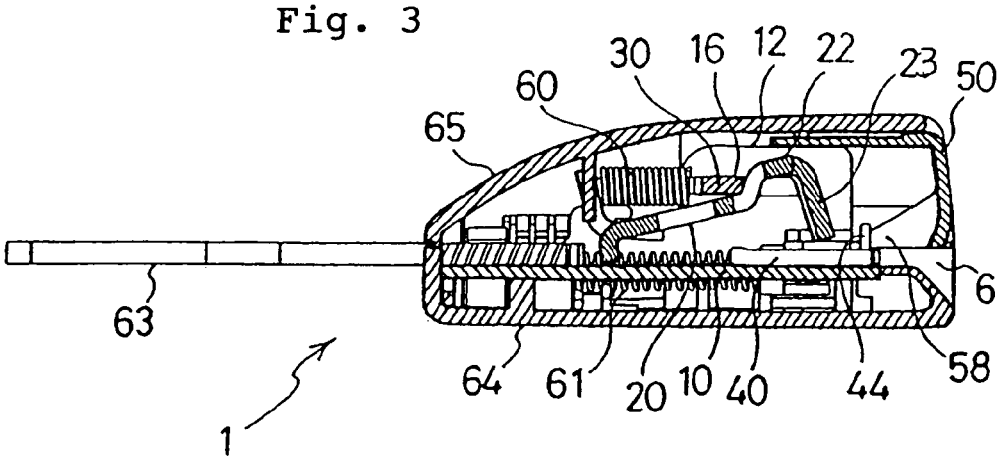
FIG. 3 is a longitudinally sectioned side view showing the buckle device according to the first invention of the present application.

As shown in FIG. 1 to FIG. 3, the buckle body 5 comprises a frame 10, a hook member 20, a lock bar 30, an ejector 40, a plastic release button 50, compressed coil springs 60, 61, an anchor member 63 which is fixed on the frame 10 with a rivet 62 and used to fix the buckle device 1 on the fixed part of the vehicle body, and a base cover 64 and lid cover 65 which are made of plastic material. Parts except for the foregoing plastic parts are metallic (for example, steel) parts.

The foregoing frame 10 is integrally formed with a base plate part 11 and a pair of side plate parts 12 rising from both left and right side edges of the base plate part 11. The base plate 11 is formed with a circular hole 13 for a rivet 62, a rectangular hole 14 to accommodate a compressed coil spring 61 which elastically urges the ejector in the forward direction and guides the movement of the ejector, a spring connection part (not shown) projecting from the rear end edge of the rectangular hole 14, and a inclined part 15 which engages with the base cover 64. The pair of the side plate parts 12 are formed with a pair of long holes 16 into which both sides of the lock bar 30 are inserted and by which the lock bar is slidably guided in forward and rearward directions, a notched pivot part 17 for pivotably supporting the hook member 20, a pair of stopper parts 18 for locking the release button 50 to prevent its detachment in the forward direction, and a pair of guide projections 19 for guiding the insertion and extraction of the tongue plate 2 and preventing the entanglement of the tongue plate 2 during insertion.

As shown in FIGS. 1 to 3, the hook member 20 comprises: a restriction part 22 which extends forward in a upwardly curved shape, a hook part 23 which bends downwardly from the restriction part and is engageable with the tongue part 3 and of which end part can fit into the end part of the rectangular hole 14 of the base plate part 11, a pair of right and left pivoted parts in the rear part, a pair of operated parts 25 which are formed to bend downwardly from the rear end of the body part and are operated by the ejector 40, and a pair of spring receiving parts 26 which are bent upwardly between the operated parts 25. A pair of left and right pivoted parts 24 are pivotably mounted on a pair of notched pivot parts of a pair of side plate parts 12 allowing the hook member 20 to pivot upward and downward by a predetermined angle.

Referring to the lock bar 30, as shown in FIGS. 1 to 3, the lock bar 30 consists of a strip-type member and is mounted across the pair of side plate parts 12 while being passed through a pair of long holes 16, and in this state, both end parts of the lock bar 30 project outwardly about 2 to 3 mm from the side plate parts 12 respectively. The lock bar 30 can move a predetermined distance forward and rearward along the pair of long holes 16. A spring receiving part 31 is formed on the middle part of the rear end part of the lock bar 30 and projecting therefrom, and a coil spring 60 (corresponding to a biasing member) is interposed in a compressed state between the spring receiving part 26 of the hook member 20 and the spring receiving part 31 of the lock bar 30. Thus, the lock bar 30 is urged forward and the hook part 23 of the hook member 20 is urged upwardly (the direction in which engagement with the tongue plate 2 is released) all the time.

When the tongue plate 5 is being inserted in the buckle body 5 in engagement with the hook member 20, the lock bar 30 stays in a first position, which corresponds to the front end portion of the pair of long holes 16, and suppresses the restriction part 22 thereby inhibiting the hook member from pivoting in the disengaging direction. And when the release button 50 is operated for disengagement, the lock bar 30 is pushed rearward by the release button 50 and is moved to a second position, which corresponds to the rear end portion of the pair of long holes 16, receding further than the restricting part 22, thereby allowing the hook member 20 to pivot in the disengaging direction.

Now referring to the ejector 40, as shown in FIGS. 1 to 3, the ejector 40 comprises an inclined guiding part 41 at the front end thereof, guided parts 42 at both right and left end parts thereof, a pair of operating parts 43 for making the hook member 20 pivot in the engagement direction by making the pair of operated parts 25 of the hook member 20 pivot rearwardly upon insertion of the tongue plate 2, a pair of left and right pushing parts 44 for pushing the release button 50 forward upon detachment of the tongue plate 2, a spring connection part 46 to which the front end part of the coil spring 61 is connected, and so forth. The ejector 40 is adapted to be movable in the forward and rearward directions on the base plate part 11 of the frame 10 and is guided without moving upward with the pair of guided parts 42 being engaged with the both side edges of the rectangular hole 14.

One end of the coil spring 61 is connected to the spring connection part 46 and the other end of the coil spring 61 is connected to the spring connection part (not shown) of the base plate part 11; thus the ejector 40 is elastically urged all the time by the urging force of the coil spring 61 in the forward direction (i.e., the detachment direction of the tongue plate 2) with respect to the frame 10.

Now referring to the release button 50, as shown in FIGS. 1 to 4, the release button 50 comprises a front end wall part 51 at the front end thereof, a pair of left and right guide wall parts 52, and a upper end wall part 53 at the upper end thereof. The pair of guide wall parts 52 are placed closely to the outer sides of the pair of side plate parts 12 of the frame 10 respectively and are formed with a pair of guide grooves 54 which face the outside of the pair of long holes 16 respectively and which guide the both ends of the lock bar movably in the forward and rearward directions. In a state in which the release button 50 is in an advance limit position (positions shown in FIGS. 2 and 3), the front ends of the guide grooves 54 are located slightly behind the front ends of the long holes 16. Each guide wall part 52 is formed with a receiving part 55, which is formed at the front edge of the guide groove 54 and is intended to receive the end part of the lock bar 30 which has moved from the second position to the first position. The foregoing pair of the receiving parts 55 formed on the pair of guide wall parts 52 constitute a stop restricting part which is integrally formed with the release button 50 and in intended to receive the lock bar 3 against the urging force of the coil spring 60 when the lock bar 30 is moved to the first position by the urging force.

A pair of left and right slits 56 are formed on the upper wall part 53 of the release button 50 to allow for the forward and rearward motion of the release button 50 with respect to a pair of stopper parts 18 of the pair of side plate parts 12 of the frame 10. When the lock bar 30 is moved from the second position to the first position by the urging force of the coil spring 60 and is received by the pair of receiving parts 55 upon insertion of the tongue plate, a pair of engaged parts 57 at the rear ends of the pair of slits 54 are locked by a pair of stopper parts 18 respectively and thereby the release button 50 is stopped in the advance limit position.

A pair of pushed parts 58, which is to be pushed forward abutting with a pair of pushing parts 44 of the ejector 40 upon detachment of the tongue plate 2 from the buckle body 5, are formed on the inner surface of the front end wall part 51 of the release button 50 and, when detaching the tongue plate 2 from the buckle body 5, the ejector 40, which is urged by the urging force of the coil spring 61, pushes the release button 50 forward (detachment direction of the tongue plate) together with the tongue plate 2 thereby making the release button 50 return to the advance limit position, and then stops. Even in this state, the ejector 40 stops leaving a certain amount of clearance from the front end of the rectangular hole 14 which is formed on the frame so as to push the release button forward urged by the urging force of the coil spring 61.

As described above, an anchor member 63 is fixed on the frame 10 via a rivet 62 and, as shown in FIGS. 1 to 3, and the frame 10 is assembled with the hook member 20, the lock bar 30, the ejector 40, the release button 50, and the coil springs 60, 61, and these assembled parts are contained within the base cover 64 and the lid cover 65. The base cover 64 and lid cover 65 are fixedly united through multiple fitting parts and engaging parts. The front end of the release button 50 faces on the front end of the buckle device 1, and the release button 50 is configured to be push-operated by depressing the front end part of the release button 50 with a finger.

Next, the actions of the buckle device 1 described so far will be explained.

Figure 5:
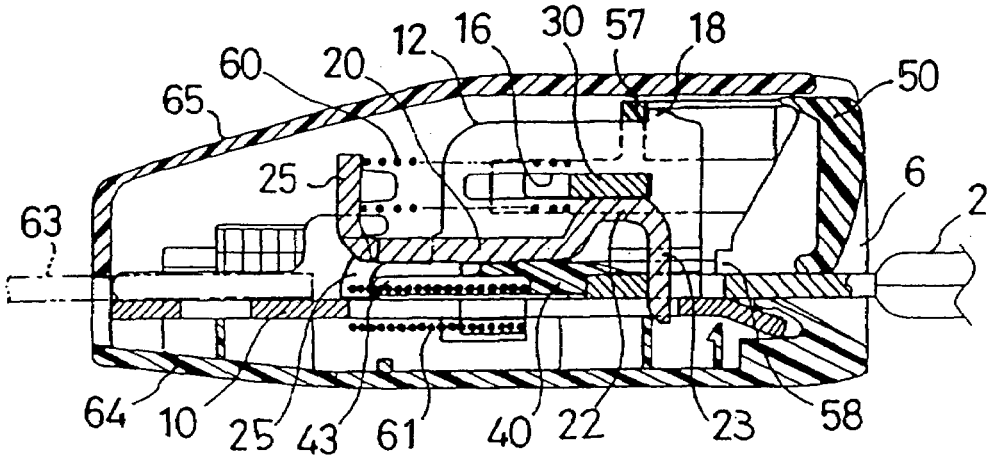
FIG. 5 is a longitudinally sectioned side view showing the buckle device (the tongue plate and the hook member are in engagement) according to the first invention of the present application.

FIG. 5 shows an engaged state in which the tongue plate 2 and the hook member 20 are brought into engagement by inserting the tongue part 3 of the tongue plate 2 into the buckle body 5. In this engaged state, the hook part 23 engages in the engaging hole 3*a* of the tongue part 3 and in the rectangular hole 14 of the frame 10 thereby locking the tongue part 3. The lock bar 30 is positioned in a first position in abutment with the upper surface of the restricting part 22 of the hook member 20, thereby restricting the pivoting of the hook member 20 in the disengaging direction, and the pair of engaged parts 57 are locked by the pair of stopper parts 18 respectively and thereby the release button is at rest in the advance-limit position.

In this engaged state, the both ends of the lock bar 30 abut with the pair of receiving parts 55 of the release button 50 and thereby the release button 50 is urged forward by the lock bar 30 which is urged by the urging force of the coil spring 60.

Figure 6:
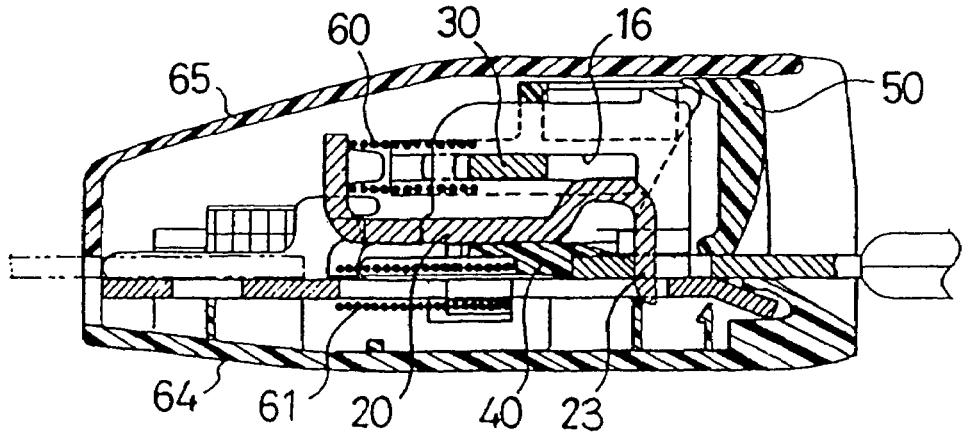
FIG. 6 is a longitudinally sectioned side view showing the buckle device (the release button is push-operated) of the first invention of the present application.

When detaching the tongue plate 2 from the buckle device 5, as shown in FIG. 6, moving the release button 50 rearward by pushing it with a finger against the urging force of the coil spring 60 causes the pair of receiving parts 55 of the release button 50 to push the both right and left ends of the lock bar 30 rearward, and thereby the lock bar 30 moves to the second position together with the release button 50 compressing the coil spring 60, and this causes the hook member 20 to pivot in the disengaging direction via the spring receiving part 26 of the hook member 20.

Figure 7:
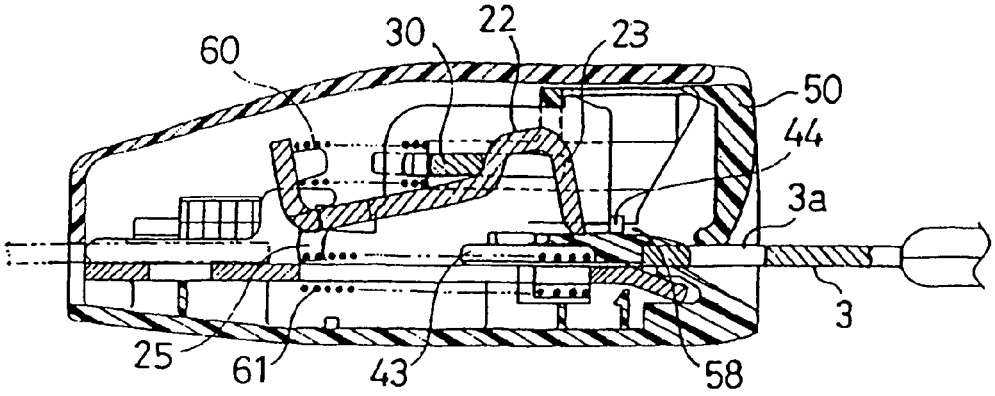
FIG. 7 is a longitudinally sectioned side view showing the buckle device (in a state in which the tongue plate has started to be extracted or has started to be inserted) according to the first invention of the present application.

Then, as shown in FIG. 7, in a state in which the lock bar 30 has reached the second position, the lock bar 30 is moved rearward further than the restricting part 22 thus moving out of abutment with the restricting part 22 so that the hook member 20 pivots to a upward limit thereby coming into a disengaged state. In this disengaged state, the tongue plate 2 is to be detached from the buckle body 5 in the forward direction, and at this time, since the front end of the ejector 40 abuts with the rear end of the tongue plate 2, the tongue plate 2 is urged forward to be detached. And since the pair of pushing parts 44 of the ejector 40 abut with the pair of pushed parts 58 of the release button 50, when the finger is removed from the release button 50, the release button 50 is urged forward by the ejector 40 which is urged by the urging force of the coil spring 61, thus returning to the advance limit position.

Next, in a detached state of the tongue plate, when inserting the tongue plate into the buckle body to connect them together, tongue part 3 of the tongue plate 2 is inserted from an insert port 6 and brought into abutment with the front end of the ejector 40, and as the tongue plate 2 is being inserted against the urging force of the coil spring 61 and thus ejector 40 is being pushed on, the pair of the operating parts 43 in the rear end of the ejector 40 come into abutment with the pair of operated parts 25 of the hook member 20 thereby causing them to pivot rearward, as shown in FIG. 5. This causes the hook member 20 to pivot in the engaging direction against the urging force of the coil spring 60 to engage in the engagement hole 3*a* of the tongue part 3, and the lock bar 30 is moved forward from the second position to the first position.

When the lock bar 30 moves from the second position to the first position, the lock bar 30 moves fast to the first position due to the urging force of the coil spring 60, since the both ends of the lock bar 30 are engaged by the pair of receiving parts 55 (stop restricting part) formed on the pair of guiding wall parts 52 of the release button 50, a collision occurs between the metal lock bar 30 and the pair of receiving parts 55 made of plastics, and therefore no impact noise between metal parts is generated and only lower and milder impact noises than those produced by a collision of metal parts are generated. Therefore, the noise in the vehicle compartment is reduced and also operation feel during engaging the tongue plate 2 is also improved.

When detaching the tongue plate 2, since the coil spring 61 is exploited to push the release button 50 and the tongue plate 2 in the detaching direction of the tongue plate, a spring member to push the release button 50 in the detaching direction of the tongue plate 50 can be eliminated, and a pair of spring receiving parts to receive the both ends of the spring member can also be eliminated. Thus the number of the parts is reduced, the structure is simplified, and the assembly of the buckle device 1 is simplified as well. Since the lock bar 30 is mounted across the pair of side plate parts 12 being passed through the pair of long holes 16 of the pair of side plate parts 12 of the frame 10, the support for both ends of the lock bar 30 is stabilized, and the pivoting of the hook member 20 in the disengaging direction is reliably inhibited when the lock bar 30 is at rest in the first position. Moreover, since the stop restricting part consists of a pair of receiving parts 55 for receiving the both ends of the lock bar 30 projecting outwardly from the pair of side plate parts 12, operational stability in receiving the lock bar 30 in the first position is secured.

Since the stopper parts 18 for locking the release button 50 against the urging force of the coil spring 60, which urges the lock bar 30, are integrally formed on the pair of side plate parts 12 of the frame 10, the release button 50 is reliably locked by the pair of stopper parts 18 integrally formed on the metal frame 10 even when a force in the disengaging direction is applied on the release button 50 by the lock bar 30, and also the stopper parts 18 can be formed conveniently at low cost.

The lock bar 30, which consists of a strip-type member, has its both ends passed through the pair of long holes 16 and is guided by the pair of guide grooves 54, therefore the release button 50 can be movably guided by the both ends of the lock bar 30 through the pair of guide grooves 54. That is, the pair of guide wall parts 52 and guide grooves thereof make it possible to restrain the lock bar 30 from moving in its longitudinal direction, thereby inhibiting the lock bar 30 from coming off the pair of long holes 16 of the frame 10. Thus, the frame 10 and the pair of long holes 16 and lock bar 30 make it possible to restrain the release button 50 from coming off the lock bar through the pair of guide wall parts 52 and guide grooves 54 thereon, thereby restricting the moving direction of the release button 50. As a result, it becomes possible, for example, to eliminate the holder member to hold the lock bar 30 or to eliminate the spring member to urge the release button 50 forward, thereby drastically simplifying the structures concerning the lock bar 30 and the release button 50.

Next, examples in which the foregoing embodiment is partially modified will be described.

1) Instead of the pair of receiving parts 55 formed on the foregoing release button 50, a stop restriction part may be integrally formed on the front end wall part 51 or the upper end wall 53 of the release button 50.

Figure 8:
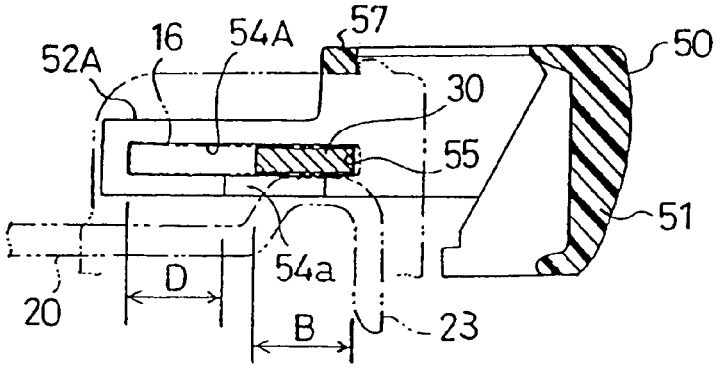
FIG. 8 is a side view showing major parts such as the guide wall part and the guide groove part of a variation of the buckle device according to the first invention of the present application.

2) As shown in FIG. 8, each guide wall part 52A of the release button 50 is extended rearward, and a guide groove 54A, which has about same length as that of the long hole 16 and faces outward from the long hole 16, is formed on each guide wall part 52A, and both longitudinal ends of the guide groove 54A are closed. In the lower part of the guide wall part 52A, there is formed an import opening part 54*a* for introducing the ends of the lock bar 30 into intermediate part of the length of the guide groove 54A from the direction perpendicular to the guide groove 54 (from downward).

The dimension D shown in the figure is configured to be larger than a half of the width B of the lock bar 30.

The import opening part 54*a* is formed in such a way that it is in communication with the intermediate part of the length of the guide groove 54A and its position does not coincide with the first and second positions of the lock bar 30. Since the dimension is arranged to be D>0.5*B (B multiplied by 5), therefore for example, even when the lock bar 30 is in the second position during assembly (before attaching the cover), at least more than half of the lock bar 30 overlaps with the guide wall part 52A making it hard to become detached from the guide groove 54A, and thus ease of handling before the cover assembly is enhanced.

Figure 9:
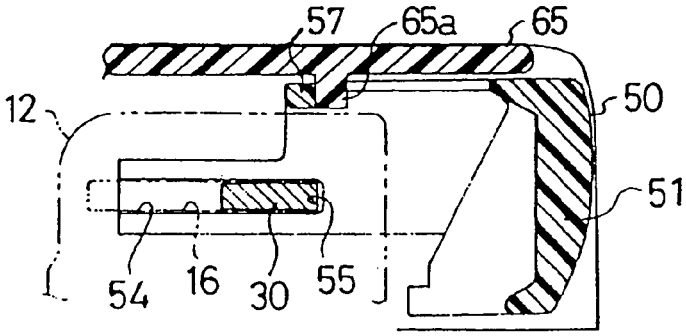
FIG. 9 longitudinally sectioned side view showing major parts of the lid cover and the release button relating to a variation of the buckle device according to the first invention of the present application.

3) As shown in FIG. 9, a pair of stopper parts 65*a*, which project from the inner surface of the lid cover 65, are formed in stead of the above described pair of stopper parts 18, so that the pair of engaged parts 57 of the release button 50 are locked by the pair of stopper parts 65*a*.

4) The above described structure of the buckle device 1 is shown by way of an example, and the present invention can be implemented with various variations of each part without departing the spirit of the present invention.

Next the embodiments of the second invention of the present application will be described referring to the drawings.

A seat belt apparatus of a vehicle is equipped with a buckle device, which is unique to the present invention and intended for connecting a webbing worn by the occupant to the vehicle body, and a pretensioner to retract the buckle body of a buckle device in the tightening direction of the webbing to tighten the webbing in an emergency of the vehicle. By way of explanation, the buckle device 1 shown in FIGS. 10 to 17 will be explained by defining the four directions: forward/rearward and rightward/leftward, as shown in FIG. 10 where arrow A denotes the forward direction.

Figure 10:
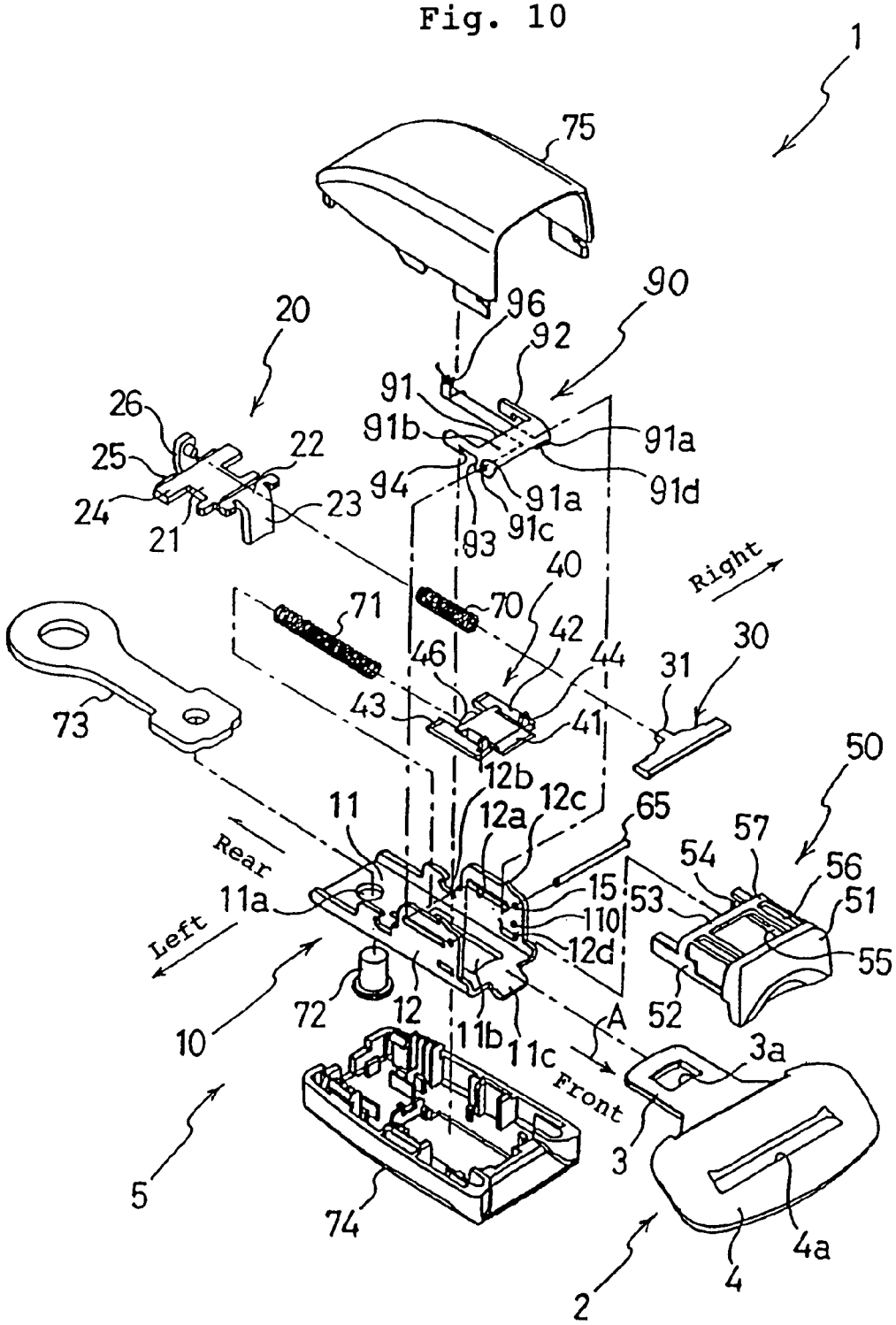
FIG. 10 is an exploded perspective view showing the buckle device according to the second invention of the present application.
Figure 11:
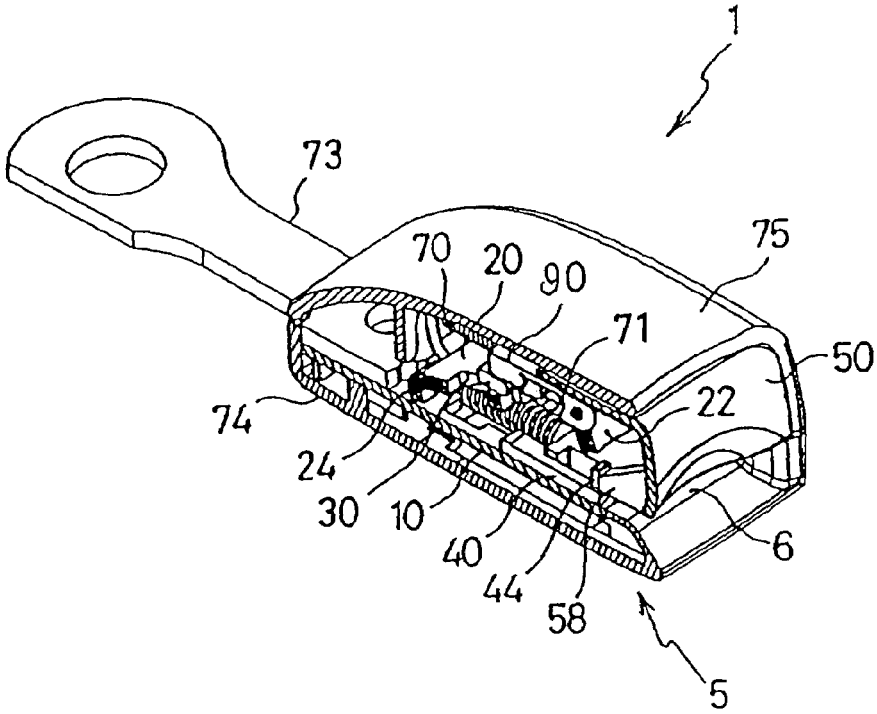
FIG. 11 is a partial cutaway and longitudinally sectioned perspective view showing the buckle device according to the second invention of the present application.
Figure 12:
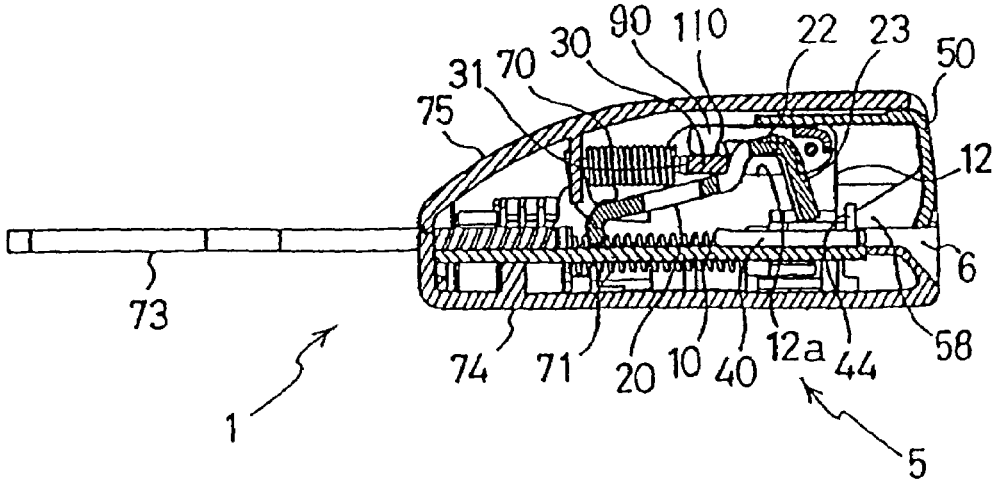
FIG. 12 is a longitudinally sectioned side view showing the buckle device according to the second invention of the present application.

As shown in FIGS. 10 to 12, the buckle device 1 basically consists of a tongue plate 2, which is movably attached to intermediate part of the webbing (not shown), and a buckle body 5. In the front end of the buckle body 5, there is provided an insert port 6 into which the tongue plate 2 is inserted. The tongue plate 2 includes a tongue part 3 made of metal and to be inserted into the buckle body 5, and a tongue body part 4 which is integrally formed with the tongue part 3 and is covered with a plastic material. The tongue part 3 is formed with a rectangular engaging hole 3*a* and the tongue body part 4*a* is formed with a webbing passage hole 4*a*.

As shown in FIGS. 10 to 12, the buckle body 5 basically consists of a frame 10, a hook member 20, a lock bar 30, a plastic ejector 40, a plastic release button 50, a lock member 90, compression coil springs 70, 71, a connecting member 73 fixed to a frame 10 with a rivet 72 and for connecting the buckle body 5 to the pretensioner, a plastic base cover 74 and lid cover 75, and so forth. Parts except for the foregoing plastic parts are made of metal (for example, steel). The lock member 90 can be made of either plastics or metal. And the buckle body 5 may be connected to the pretensioner via a member other than the connecting member 73.

The foregoing frame 10 is integrally formed with a base plate part 11 and a pair of side plate parts 12 rising from both left and right side edges of the base plate part 11. The base plate part 11 is formed with a circular hole 11*a* for a rivet 72, a rectangular hole 11*b* to accommodate a compressed coil spring 71 for elastically urging the ejector 40 in the forward direction and guides the movement of the ejector 40, a spring connecting part (not shown) projecting from the rear end edge of the rectangular hole 11*b*, and an inclined part 11*c* which engages with the base cover 74.

The pair of the side plate parts 12 is formed of a pair of long holes 12*a* into which both sides of the lock bar 30 are inserted and by which the lock bar is guided slidably in the forward and rearward directions, a notched pivot part 12*b* to pivotably support the hook member 20, a pair of stopper parts 12*c* to lock the release button 50 so that it does not come off forwardly, and a pair of guide projections 12*d* to guide the insertion and extraction of the tongue plate 2 and to prevent entanglement of the tongue plate 2 during insertion. Further, the pair of side plate parts 12 are formed with a pair of axial holes 15 for pivotably supporting the axial member 95, the ends of the lateral axial member 95 being inserted in the axial holes 15, the axial member being passed through the lock member 90. The right side plate part is formed with a spring mounting hole 110 which is located under the axial hole 15 and is intended to mount one end of the torsion spring 96 to pivotally urge the lock member 90.

As shown in FIGS. 10 to 13, the hook member 20 comprises: a body part 21, a restriction part 22 which extends forward in a upwardly curved shape, a hook part 23 which bends downwardly from the restriction part and is engageable in an engaging hole 3*a* of the tongue plate 2 and of which tip part fits into the end part of the long hole 11*b* of the base plate part 11, a pair of right and left pivoted parts in the rear part, a pair of operated parts 25 which are formed bending downwardly from the rear end of the body part 21 and are operated by the ejector 40, and a pair of spring receiving parts 26 which are bent upwardly between the operated parts 25. A pair of left and right pivoted parts 24 are pivotably mounted on a pair of notched pivot parts 12*b* of a pair of side plate parts 12 allowing the hook member 20 to pivot upward and downward within a predetermined angle.

Referring to the lock bar 30, as shown in FIGS. 10 to 12, the lock bar 30 consists of a strip-type member and is mounted across the pair of side plate parts 12 while being passed through a pair of long holes 12*a*. In this state, both end parts of the lock bar 30 project outwardly about 2 to 3 mm from the side plate parts 12 respectively. The lock bar 30 can move a predetermined distance forward and rearward along the pair of long holes 12*a*. The middle part of the rear end part of the lock bar 30 is formed with a spring receiving part 31 projecting therefrom, and a coil spring 70 (corresponds to a biasing member) is interposed in a compressed state between the spring receiving part 26 of the hook member 20 and the spring receiving part 31 of the lock bar 30. Thus, the lock bar 30 is urged forward and the hook part 23 of the hook member 20 is urged upwardly (the direction in which engagement with the tongue plate 2 is released) all the time.

When the tongue plate 2 is being inserted in the buckle body 5 in engagement with the hook member 20, the lock bar 30 stays in a first position, which corresponds to the front end portions of the pair of long holes 12*a*, and suppresses the restriction part 22 from upward thereby inhibiting the hook member from pivoting in the disengaging direction (upward). And when the release button 50 is operated for disengagement, the lock bar 30 is pushed rearward by the release button 50 and is moved to a second position, which corresponds to the rear end portions of the pair of long holes 12*a*, receding further than the restricting part 22, thereby allowing the hook member 20 to pivot in the disengaging direction.

Now referring to the ejector 40, as shown in FIGS. 10 to 12, the ejector 40 comprises an inclined guiding part 41 at its front end, guided parts 42 at both right and left ends thereof, a pair of operating parts 43 for making the hook member 20 pivot in the engagement direction by pushing the pair of operated parts 25 of the hook member 20 rearwardly upon insertion of the tongue plate 2, a pair of left and right pushing parts 44 for pushing the release button 50 forward upon detachment of the tongue plate 2, a spring connection part 46 to which the front end part of the coil spring 71 is connected, and the like. The ejector 40 is disposed movably in the forward and rearward directions on the base plate part 11 of the frame 10. The pair of the guided parts 42 are nearly U-shaped in the cross section and these U-shaped parts are engaged with the both side edges of the rectangular hole 11*b* so that the ejector is guided without moving upward.

The front end part of the coil spring 71 is inserted into and connected to the spring connection part 46 and the rear end of the coil spring 71 is connected to the spring connection part (not shown) of the base plate part 11; thus the ejector 40 is elastically urged by the urging force of the coil spring 71 in the forward direction (i.e., the detachment direction of the tongue plate 2) with respect to the frame 10.

Now referring to the release button 50, as shown in FIGS. 10 to 12, the release button 50 comprises a front end wall part 51 at its front end, a pair of left and right guide wall parts 52, and a upper end wall part 53 at its upper end. The pair of guide wall parts 52 are closely placed to the outer sides of the pair of side plate parts 12 of the frame 10 respectively and are formed with a pair of guide grooves 54 which guide the both ends of the lock bar 30 movably in forward and rearward directions, the both ends of the lock bar 30 projecting outwardly from the pair of long holes 12*a* respectively.

In a state in which the release button 50 is in an advance limit position (positions shown in FIGS. 11 and 12), the front ends of the guide grooves 54 are located slightly behind the front ends of the long holes 12*a*. Each guide wall part 52 is formed with a receiving part 55 which is formed at the front edge of the guide groove 54 and is intended to receive the end part of the lock bar 30 which has moved from the second position to the first position.

The foregoing pair of the receiving parts 55 formed on the pair of guide wall parts 52 constitute a stop restricting part which is integrally formed with the release button 50 and is intended to receive the lock bar 3 against the urging force of the coil spring 70 when the lock bar 30 is moved to the first position by the urging force.

A pair of left and right slits 56 are formed on the upper wall part 53 of the release button 50 to allow for the forward and rearward motion of the release button 50 with respect to a pair of stopper parts 12*c* of the pair of side plate parts 12 of the frame 10. When the lock bar 30 is moved from the second position to the first position by the urging force of the coil spring 60 upon insertion of the tongue plate 2 and is received by the pair of receiving parts 55, a pair of engaged parts 57 at the rear end of the pair of slits 54 are locked by a pair of stopper parts 12*c* respectively thereby causing the release button 50 to stop in an advance limit position.

A pair of pushed parts (not shown), which are to be pushed forward abutting with a pair of pushing parts 44 of the ejector 40 upon detachment of the tongue plate 2 from the buckle body 5, are formed on the inner surface of the front end wall part 51 of the release button 50. When detaching the tongue plate 2 from the buckle body 5, the ejector 40, which is urged by the urging force of the coil spring 71, pushes forward (in the direction of tongue plate detachment) the release button 50 together with the tongue plate 2 thereby making the release button 50 return to the advance limit position, and then stops. Even in this state, the ejector 40 stops leaving a certain amount of clearance from the front end of the rectangular hole 14 which is formed on the frame so as to push the release button forward urged by the urging force of the coil spring 71.

Now the lock member 90 will be described.

As shown in FIGS. 10 to 13, the lock member 90 includes: a base end part 91, which is arranged between the pair of side plate parts 12 of the frame 10 and is long in the right and left direction, and a pair of lever parts 92 which extend nearly rearward from the right and left ends of the base end part 91. The base end part 91 consists of a pair of side plate parts 91*a* which locates in the right and left ends, and a horizontal part 91*b* to link the upper end parts of the side plate parts 91*a*. A pair of pivot holes 91*c*, of which center are shifted downward from the center of gravity of the lock member 90, are formed concentrically on the pair of side plate parts 91*a*, and a axial member 95 is passed through the pivot holes 91*c*. The both ends of the axial member 95 are passed through a pair of axial holes 15 and thereby the base end part 91 of the lock member 90 is pivotably mounted on the plate 10 through the axial member 95.

A rib 91*d* is integrally formed on the base end part 91 of the lock member 90 and is located closely facing the right side plate part 91*a*. A passage hole (not shown) for passing the axial member 95 is formed on the rib 91*d*. A torsion spring 96 (elastic member) is disposed between the closely facing side plate parts 91*a* and rib 91*c*, and a axial member 95 is passed through the torsion spring 96. One end of the torsion spring 96 is contacted with and attached to the horizontal part 91*b* of the lock member 90 from downward, and the other end is passed through and attached to the spring attachment hole 110, and thus the lever part 92 is elastically urged upward all the time by the torsion spring 96. Here the rib 91*d* may be eliminated.

The lock member 90 includes a pair of first engaging parts 93 which are formed near the base end part 91 and a pair of second engaging parts 94 which are placed at the tip part of the pair of levers 92 and which face the pair of first engaging parts 93 respectively keeping an enough clearance to receive the lock bar 30. The lock member 90 is mounted pivotably between a lock position in which the lock bar 30 is locked in the first position and a non-lock position in which the lock bar 30 is not locked, and is elastically urged by the torsion spring 96 to the non-lock side all the time.

The first engaging part 93 is disposed in such a way that it may abut with the first position side end part (front end part) of the lock bar 30, and the lock member 90 is pivotally urged toward the non-lock position in a state in which the tongue plate 2 is not being inserted, i.e., in a state the lock bar 30 stays in the second position, the first engaging part 93 positions slightly behind the front end of the movable area of the lock member 90 and has not intruded into the movable area of the lock bar 30 except for the first engaging part 93 including the second engaging part 94 of the lock member 90.

Here, the base end part 91 of the lock member 90 is pivotally supported at a position away from the plane including the movable area of the lock bar 30 on the opposite side of the hook member 20, specifically an obliquely upward position from the movable area of the lock bar 30. Therefore, the lock bar 30 which is urged toward the first position abuts the first engaging part 93 thereby causing the lock member 90 to pivot to the lock position, and in that sate, the lock bar abuts with the first engaging part 93 thereby maintaining the lock position. And while in this lock position, the second engaging part 94, which protrudes into the movable area of the lock bar 30, closely faces the second position side end part (rear end part) of the lock bar 30 allowing for abutment.

Figure 17:
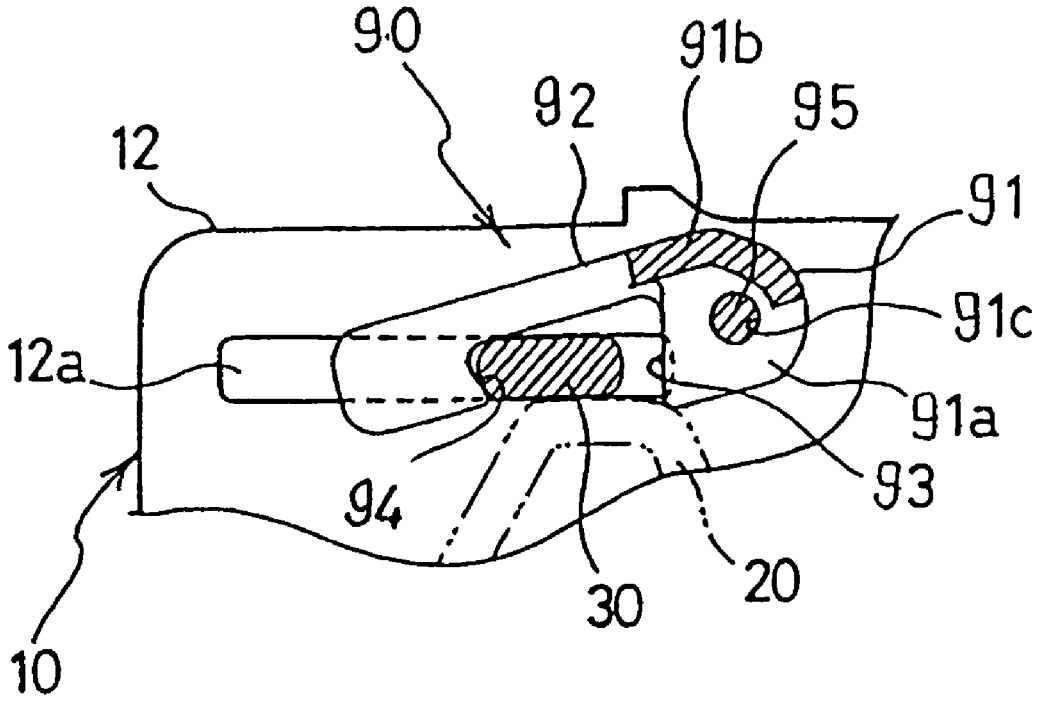
FIG. 17 is an enlarged view showing the lock member and the lock bar.

On the other hand, as shown in FIG. 17, the second engaging part 94 of the lock member 94 is formed in a shape which is inclined obliquely downward when the lock member 90 is near the lock position so that a pivotal force is generated through contact with the lock bar 30 moving to the second position. The buckle body 5 (lock member 90) is subjected to a rearward inertial force when the buckle body 5 suddenly stops after operation of the pretensioner. The center of gravity of the lock member 90 is disposed above the pivot axis (rotational axis) of the lock member 90 so that the lock member 90 is caused to pivot toward the lock position by the foregoing inertial force which acts on the center of gravity of the lock member 90.

As described before, connection member 73 is fixed to the frame 10 with a rivet 72 as shown in FIGS. 10 to 12, and the frame 10 is assembled with a hook member 20, a lock bar 30, an ejector 40, a release button 50, a lock member 90, coil springs 70, 71 and the like, and all of these are assembled so as to be contained inside a base cover 74 and a lid cover 75, and then the base cover 74 and lid cover 75 are fixedly integrated through a plurality of fitting parts and engaging parts. The front end of the release button 50 faces out on the front end of the buckle device 1, and the release button 50 is configured to be operable by depressing the front end part of the release button 50 with a finger.

Next, the functions and advantages of the above described buckle device 1 will be explained.

Figure 13:
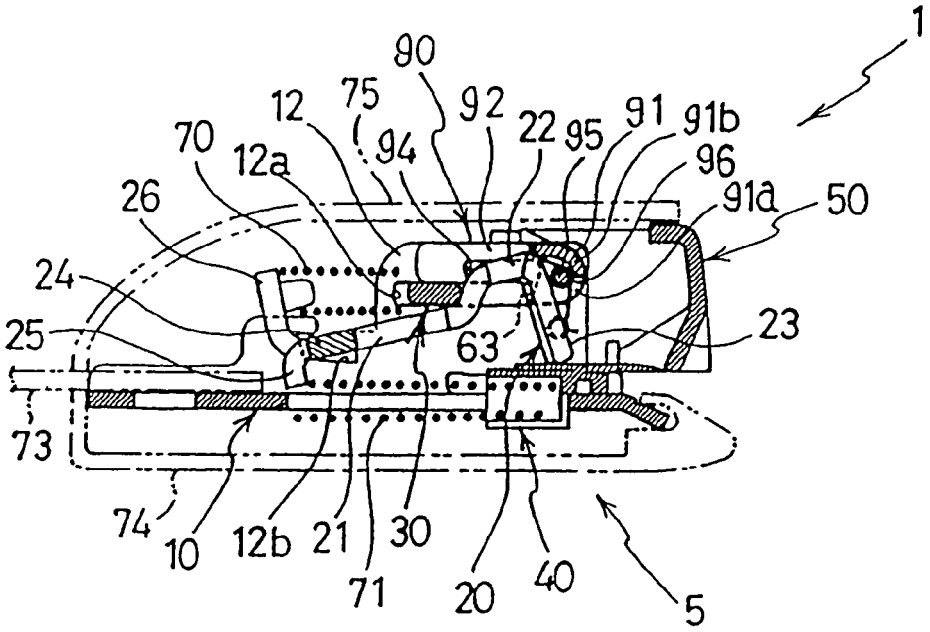
FIG. 13 is a longitudinally sectioned side view showing the buckle device (the tongue plate is not inserted) of the second invention of the present application.

FIG. 13 shows a state in which the tongue plate 2 is being detached from the buckle body 5, and the lock member 90 is urged toward the non-lock position by the torsion spring 96. When, from this state, the tongue part 3 of the tongue plate 2 is further inserted into the buckle body 5 through a insert port 6, firstly the tongue part 3 comes into abutment with the front end of the ejector 40.

Figure 4:
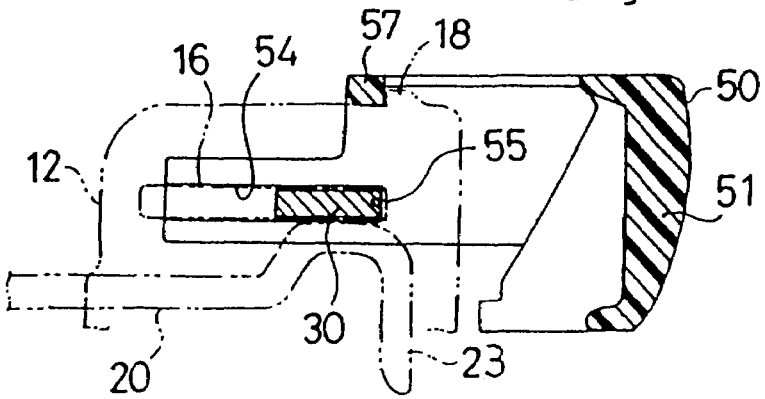
FIG. 4 is a side view showing major parts such as the guide wall part and guide groove of the release button.

Upon further inserting the tongue plate 2 and pushing the ejector 40 against the urging force of the coil spring 71, a pair of operating parts 42 at the rear end of the ejector 40 come into abutment with a pair of operated parts 25 of the hook member 20 and cause them pivot reward; this causes, as shown in FIG. 4, the hook member 20 to pivot in the engaging direction against the urging force of the coil spring 70 and comes into engagement with the engaging hole 3*a* of the tongue part 3, and thereby the lock bar 30 is moved from the second position to the first position by the urging force of the coil spring 70.

Figure 14:
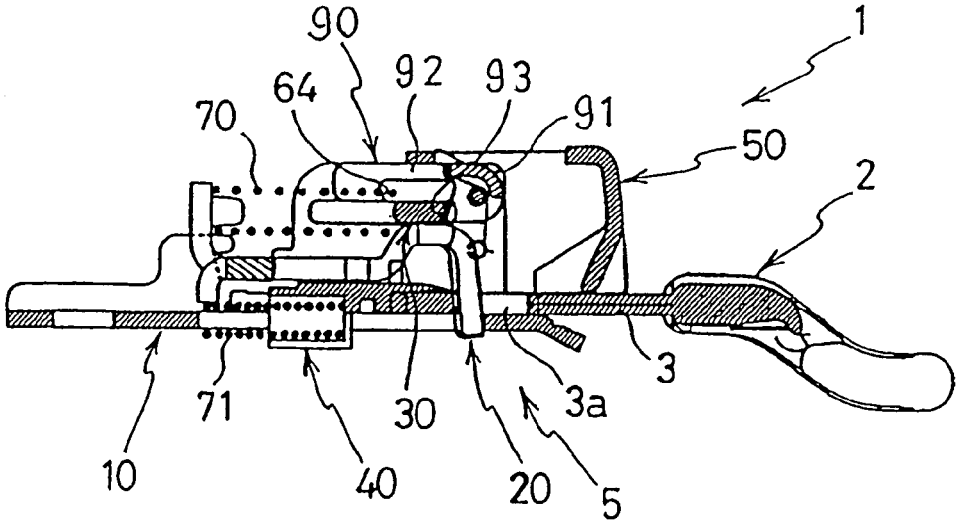
FIG. 14 is a longitudinally sectioned side view showing the buckle device (the tongue plate is inserted) according to the second invention of the present
Figure 15:
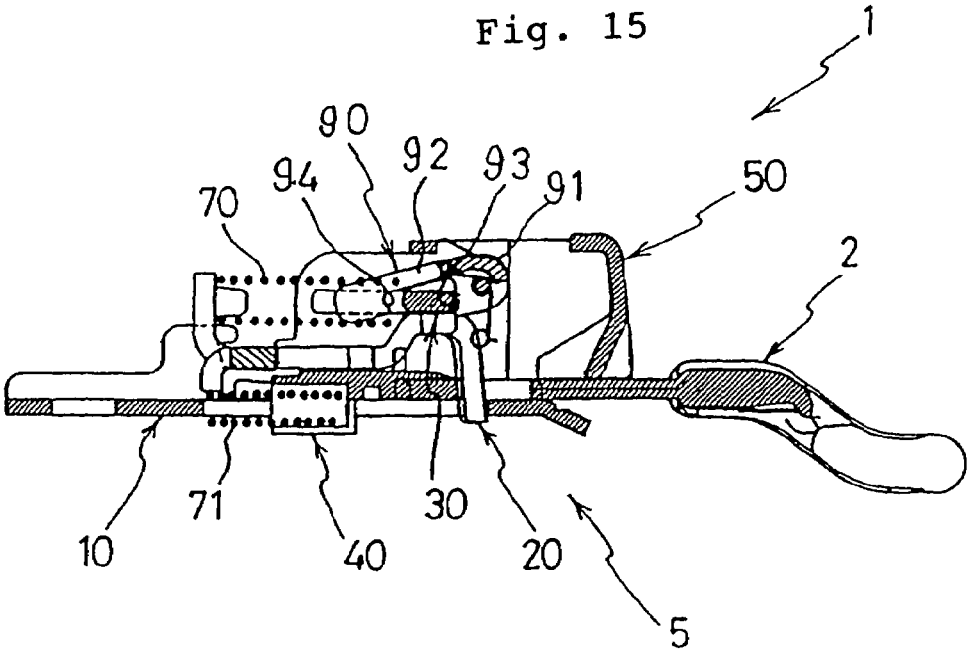
FIG. 15 is a longitudinally sectioned side view showing the buckle device (the insertion of the tongue frame is completed) according to the second invention of the present application.
Figure 16:
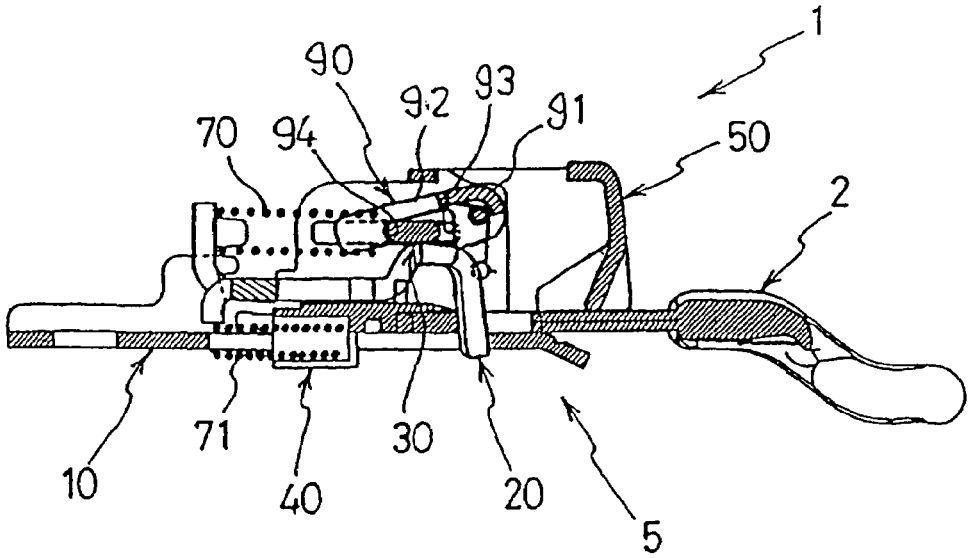
FIG. 16 is a longitudinally sectioned side view showing the buckle device (when the buckle body has abruptly stopped) according to the second invention of the present application.

When the lock bar 30 moves from the second position to the first position, since the lock member 90 is in the non-lock position and the second engaging part 94 has not intruded into the movable area of the lock bar, the lock bar 30 does not interfere with the second engaging part 94, and as shown in FIG. 14, the first position side end part of the lock bar 30 abuts with the first engaging part 93 and then, as shown in FIG. 15, causes the lock member 90 to pivot to the lock position. Then, the lock bar 30 is received between the first and second engaging parts 93,94, and in that state, the first position side end part of the lock bar 30 abuts against the first engaging part 93 holding the lock position, and the second engaging part 94 intrudes into the movable area of the lock bar 30 closely facing the lock bar 30.

In an engagement state in which the tongue part 3 of the tongue plate 2 is inserted in the buckle body 5 and the tongue plate 2 and the hook member 20 are engaged, the hook part 23 locks the tongue part 3 by engaging in the engaging hole 3*a* of the tongue part 3 and in the rectangular hole 11*b* of the frame 10. Also, the lock bar 30 rests in the first position and abuts against the upper surface of the restricting part 22 of the hook member 20 restraining the hook member 20 from pivoting in the disengaging direction, and a pair of operated parts 57 of the release button 50 are locked by the pair of stopper parts 12*c* respectively and the release button 50 is at rest in the advance limit position. In this engagement state, the both ends of the lock bar 30 abuts against the pair of receiving parts 55 of the release button 50 respectively and thus release button 50 is urged forward by the lock bar 30 which is urged by the coil spring 70.

When detaching the tongue plate 2 from the buckle device 5, moving the release button 50 rearward by pushing it with a finger against the urging force of the coil spring 70 causes the pair of receiving parts 55 of the release button 50 to push the both right and left ends of the lock bar 30 rearward, and thereby the lock bar 30 is moved to the second position together with the release button 50 compressing the coil spring 70, and this causes the hook member 20 to pivot in the disengaging direction via the spring receiving part 26 of the hook member 20.

In this state in which the tongue plate 2 is being inserted, the second engaging part 94 protrudes into the movable area of the lock bar 30 closely facing the lock bar 30, and when the lock bar 30 starts moving from the first position to the second position, immediately afterward the instance, the lock bar 30 disengages from the first engaging part 93 and the lock member 90, which is urged by the torsion spring 96, starts pivoting to the non-lock side. Since the switching of the lock bar 30 from the first position to the second position is conducted manually and therefore is not so fast, the lock bar 30 moves to the second position without contacting the second engaging part 94 after the lock member 90 has pivoted to the non-lock position.

Then, as shown in FIG. 13, in a state in which the lock bar 30 has reached the second position, the lock bar 30 moves rearward further than the restricting part 22 coming out of abutment with the restricting part 22 so that the hook member pivots to a upward limit thereby coming into a disengaged state. In this disengaged state, the tongue plate 2 is to be detached from the buckle body 5 in the forward direction, and at this time, since the front end of the ejector 40 abuts with the rear end of the tongue plate 2, the tongue plate 2 is urged forward and then detached. And since the pair of pushing parts 44 of the ejector 40 abut the pair of pushed parts 58 of the release button 50, when the finger is removed from the release button 50, the release button 50 is urged forward by the ejector 40 which is urged by the urging force of the coil spring 71, thus returning to the advance limit position.

In an emergency of the vehicle such as a vehicle collision, the buckle body 5 is retracted by a predetermined amount in the tightening direction of the webbing thereby restraining the occupant firmly by the webbing. At the same time, in the buckle device 1, the lock member 90 and others operate to prevent the tongue plate 2 from being detached from the buckle body 5.

Upon operation of the pretensioner, the buckle body 5 is retracted in the tightening direction of the webbing, i.e., in the rearward direction and then stops abruptly. At this time, first the lock member 90 is subjected to an inertial force in the forward direction just after the buckle body 5 starts moving rearward. In this situation, the inertial force acts as a pivotal force to urge the lock member 90 to pivot to the non-lock position and the lock bar 30 is also subjected to an inertial force toward the first position, therefore the masses of the lock member 90 and lock bar 30, urging forces, the pivot position of the lock member 90 and others should be arranged such that the lock member 90 is suppressed and held in the lock position by the lock bar 30 which is urged by the inertial force and the urging force of the coil spring 70 to the first position.

Subsequently, when the buckle body 5 stops abruptly, the lock bar 30 undergoes an inertial force and starts moving toward the second position. When the tongue plate 2 is being inserted into the buckle body 5, as described above, the lock member 90 is held in the lock position and the second engaging part 94 protrudes into the movable area of the lock bar 30 closely facing the lock bar 30, therefore the lock bar 30, which has started to move to the second position, is to be received by the second engaging part and thus the movement of the lock bar 30 to the second position is inhibited; thus it becomes possible to securely prevent detachment of the tongue plate 2 from the buckle body 5 is securely prevented.

The lock member 90 is pivotably mounted on the frame 10 via the axial member 95 as the pivot part of which center is off the center of gravity of the lock member 90. When the buckle body 5 abruptly stops after operation of the pretensioner, an inertial force acts on the lock member 90 urging it to pivot to the lock position, and therefore the second engaging part 94 can securely receive the lock bar 30 which has started to move toward the second position.

Since the second engaging part 94 of the lock member 90 is configured to generate a pivot force to cause the lock member 90 to pivot toward the lock position upon contacting with the lock bar 30 which moves to the second position, it is possible to securely make the lock member 90 pivot to the lock position when the lock bar 30, which has started to move toward second position, comes into contact with the second engaging part 94 even in a state in which the second engaging part 94 of the lock member 90 has not intruded fully into the movable area of the lock bar 30. That is, it is possible to securely receive the lock bar 30 by the second engaging part 94 by making the second engaging part 94 fully intrude into the movable area of the lock bar 30.

Since the base end part 91 of the lock member 90 is pivotally mounted on the frame 10 at a position away from the plane including the movable area of the lock bar 30 in an direction opposite the hook member 20, it is possible to make the first side end part of the lock bar 30, which moves to the first position, push the lock member 90 securely causing it pivot to the lock position and maintain the lock position.

Thus, in a normal state other than an emergency of the vehicle, smooth and secure insertion and extraction operations of the tongue plate 2 are achieved because the tongue plate 2 comes into abutment with the lock bar 30 only when inserting the tongue plate 2, and does not get involved in the insertion and extraction operation. Moreover, a structure to prevent detachment of the tongue plate 2 from the buckle body 5 is achieved by a simple structure consisting of a lock member 90 and a torsion spring 96, which will bring about benefits in production cost.

Following operation of the pretensioner, the lock bar 30 is moved back to the first position from the second position by the urging force of the coil spring 70, and thereby the lock member 90 is held in the lock position thus returning to a normal state. Thus the occupant can freely insert and extract the tongue plate 2 into and from the buckle body 5.

Next, variations of the above described embodiment are described.

The buckle body 5 may be connected to the vehicle body through a connecting member 73 eliminating the above described pretensioner. That is, although there is no inertia force produced by the operation of the pretensioner and subsequent abrupt stop of the buckle body 5, since the above described functions are realized by the inertial force produced by impact force during an emergency such as a vehicle collision, it is possible to securely prevent detachment of the tongue plate 2 from the buckle body 5 during a vehicle collision.

It is not always necessary to configure such that the lock member 90 maintains the lock position by an inertial force which acts on it upon an abrupt stop of the buckle body 5 after operation of the pretensioner. That is, it is at least necessary to configure that the inertial force which acts on the lock member 90 will not act as a pivot force to cause the lock member 90 to pivot to the non-locking side upon an abrupt stopping of the buckle body 5, or even if it acts as a pivot force urging to pivot to the non-locking side, it will be enough to make the lock bar 30 comes into contact with the second engaging part 94.

The lock member 90 may be pivotally supported at intermediate part of the longitudinal direction. The structure of the above described buckle device 1 is shown by way of example, and the present invention can be embodied in various forms in which modifications are made on each part without departing its the scope. Moreover, the buckle devices according to the present embodiments are not limited for use in seat belt apparatuses for vehicles such as automobiles, and are also applicable to buckle devices used in airplanes and high speed vessels.

Next, the embodiments of the buckle device according to the third invention of the present application will be described referring to the drawings.

A seat belt apparatus of a vehicle is provided with a buckle device, which is unique to the present invention and intended for connecting a webbing worn by the occupant to the vehicle body, and a pretensioner for retracting the buckle body of the buckle device in the tightening direction of the webbing to tighten the webbing in an emergency of the vehicle. By way of explanation, the buckle device 1 shown in FIGS. 18 to 24 will be explained by defining the four directions: forward/rearward and rightward/leftward, as shown in FIG. 18 where arrow A denotes the front direction.

Figure 18:
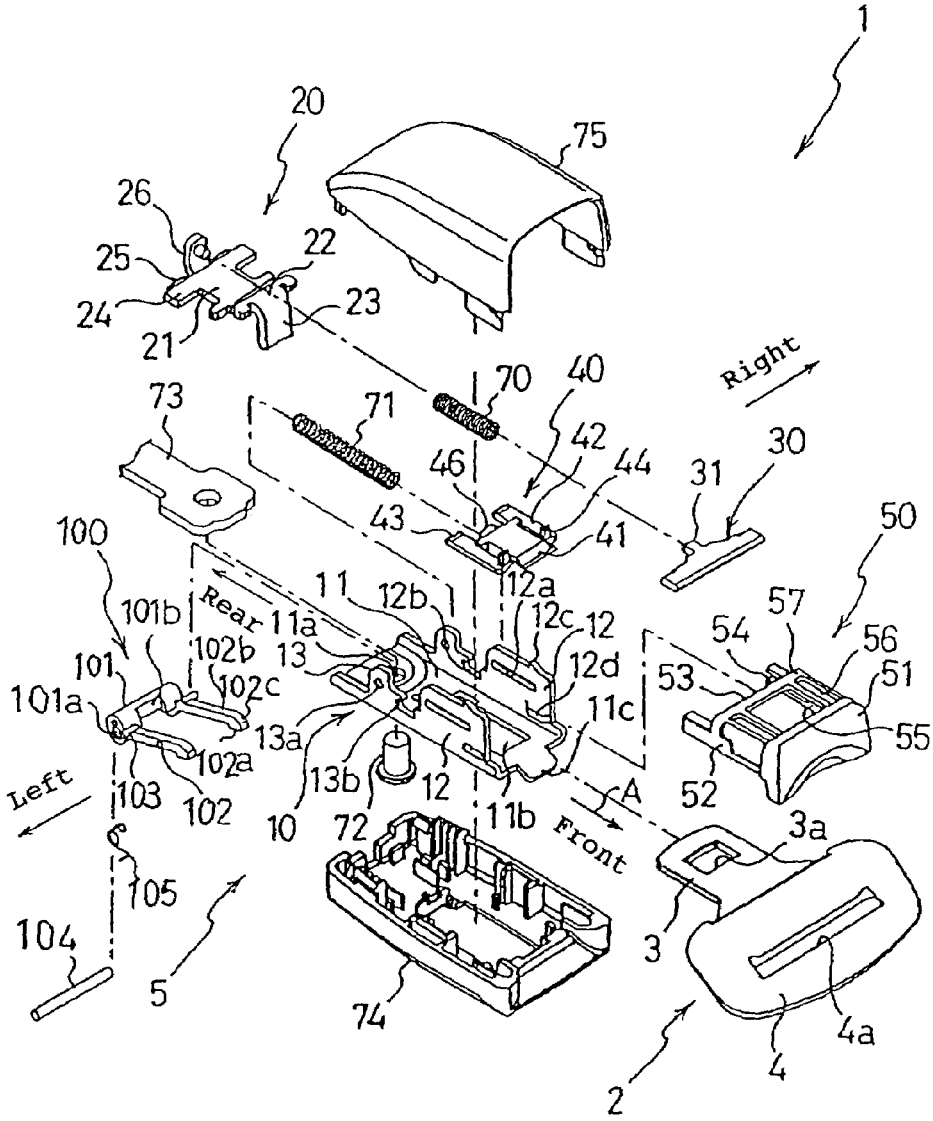
FIG. 18 is an exploded perspective view showing an embodiment of the buckle device according to the third invention of the present application.
Figure 19:
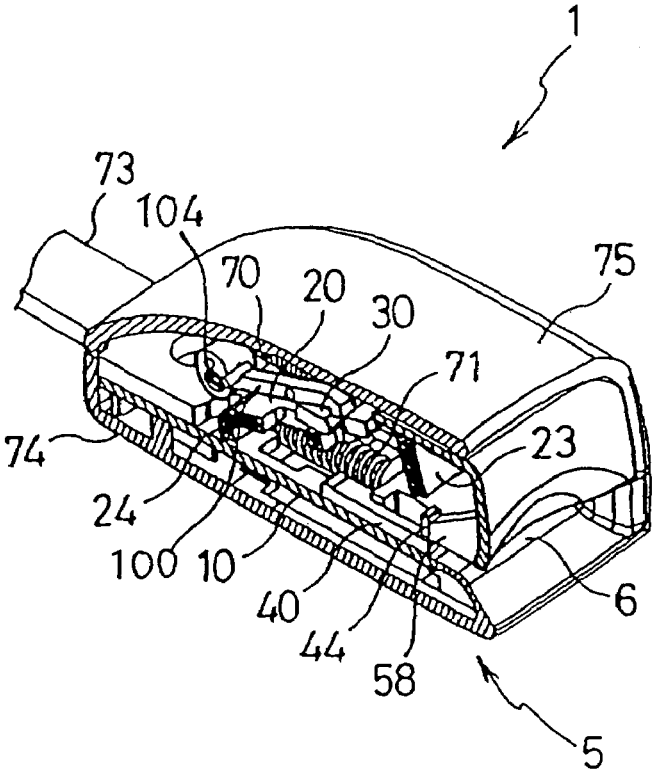
FIG. 19 is a partial cutaway and longitudinally sectioned perspective view showing the buckle device of the third invention of the present application.
Figure 20:
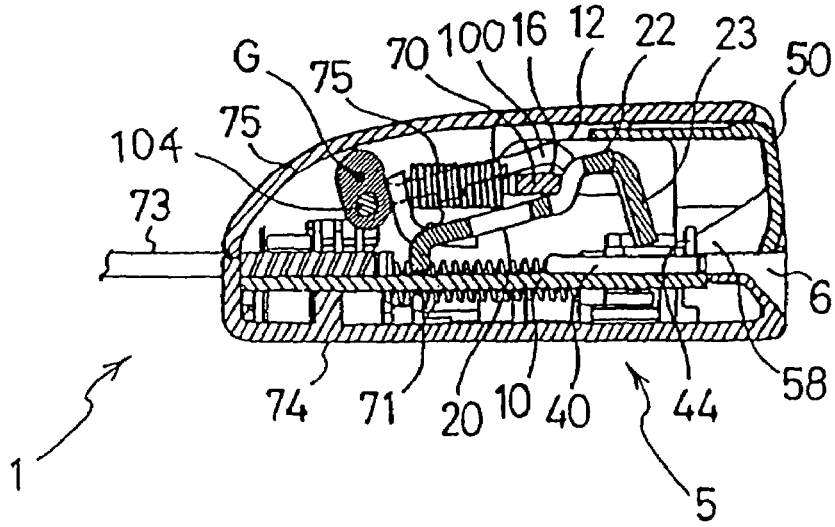
FIG. 20 is a longitudinally sectioned side view showing the buckle device according to the third invention of the present application.

As shown in FIGS. 18 to 20, the buckle device 1 basically consists of a tongue plate 2, which is movably attached to intermediate part of the webbing (not shown in the figure), and a buckle body 5. In the front end of the buckle body 5, there is provided an insert port 6, into which the tongue plate 2 is inserted. The tongue plate 2 includes, a tongue part 3 which is made of metal and is to be inserted into the buckle body 5, and a tongue body part 4 which is integrally formed with the tongue part 3 and is covered with a plastic material. The tongue part 3 is formed with a rectangular engaging hole 3*a* and the tongue body part 4*a* is formed with a webbing passage hole 4*a*.

As shown in FIGS. 18 to 20, the buckle body 5 is comprised of a frame 10, a hook member 20, a lock bar 30, an plastic ejector 40, a plastic release button 50, a lock lever 100, compressed coil springs 70, 71, a connecting member 73 which is fixed to a frame 10 with a rivet 72 and is intended to connect the buckle device 1 to the pretensioner, a base cover 74 and lid cover 75 made of plastics, and others. Parts except for the foregoing plastic parts are metal parts (for example, steel). The lock member 90 may be made of either plastics or metal. And the buckle body 5 may be connected to the pretensioner through a member other than the connecting member 73.

The foregoing frame 10 is integrally formed with a base plate part 11 and a pair of side plate parts 12 rising from both left and right side edges of the base plate parts 11. The base plate 11 comprises: a circular hole 11*a* for a rivet 72, a rectangular hole 11*b* to accommodate a compressed coil spring 71 which elastically urges the ejector in the forward direction and guides the movement of the ejector 40, a spring connecting part (not shown) projecting from the rear end edge of the rectangular hole 11*b*, and an inclined part 11*c* which engages with the base cover 74.

The pair of side plate parts 12 are formed with a pair of long holes 12*a* into which both sides of the lock bar 30 are inserted and by which the lock bar is guided slidably in the forward and rearward directions, a notched pivot part 12*b* to pivotably support the hook member 20, a pair of stopper parts 12*c* to lock the release button 50 so as not to come off forwardly, a pair of guide projections 12*d* to guide the insertion and extraction of the tongue plate 2 and to prevent the entanglement of the tongue plate 2 during insertion.

In the side plate rear part 13 of the pair of side plate parts 12, there is formed a pair of axial holes 13*a* to which both ends of the lateral axial member 104 are inserted and which pivotably support the axial member 104, which is fixedly fitted inside the lock member 100, and the left side rear plate part 13*a* is formed with a spring mounting part 13*b* to which one end of the torsion spring 105 is attached for pivotally urging the lock-lever 100 upward.

As shown in FIGS. 18 to 21, the hook member 20 comprises: a body part 21, a restriction part 22 which extends forward in a upwardly curved shape, a hook part 23 which bends downwardly from the restriction part and is engageable in an engaging hole 3*a* of the tongue plate 2 and of which tip part fits into the end part of the long hole 11*b* of the base plate part 11, a pair of right and left pivoted parts in the rear part, a pair of operated parts 25 which are formed bending downwardly from the rear end of the body part 21 and are operated by the ejector 40, and a pair of spring receiving parts 26 which are bent upwardly between the operated parts 25. A pair of left and right pivoted parts 24 are pivotably mounted on a pair of notched pivot parts 12*b* of a pair of side plate parts 12 allowing the hook member 20 to pivot upward and downward within a predetermined angle.

Referring to the lock bar 30, as shown in FIGS. 18 to 20, the lock bar 30 consists of a strip-type member and is mounted across the pair of side plate parts 12 while being inserted into a pair of long holes 12*a*, and in this state, both end parts of the lock bar 30 project outwardly about 2 to 3 mm from the side plate parts 12 respectively. The lock bar can move a predetermined distance forward and rearward along the pair of long holes 12*a*. The middle part of the rear end part of the lock bar 30 is formed with a spring receiving part 31 projecting therefrom, and a coil spring 70 (corresponds to a biasing member) is interposed in a compressed state between the spring receiving part 26 of the hook member 20 and the spring receiving part 31 of the lock bar 30. Thus, the lock bar 30 is urged forward and the hook part 23 of the hook member 20 is urged upward (the direction in which engagement with the tongue plate 2 is released) all the time.

When the tongue plate 2 is being inserted into the buckle body 5 in engagement with the hook member 20, the lock bar 30 stays in a first position, which corresponds to the front end part of the pair of long holes 12*a*, and suppresses the restriction part 22 from upward thereby inhibiting the hook member 20 from pivoting in the disengaging direction (upward). And when the release button 50 is operated for disengagement, the lock bar 30 is pushed rearwardly by the release button 50 and is moved to a second position, which corresponds to the rear end portion of the pair of long holes 12*a*, receding further than the restricting part 22, thereby allowing the hook member 20 to pivot in the disengaging direction.

Now referring to the ejector 40, as shown in FIGS. 18 to 20, the ejector 40 comprises: an inclined guiding part 41 at its front end, guided parts 42 at both right and left ends thereof, a pair of operating parts 43 for pivoting the hook member 20 in the engagement direction by pushing the pair of operated parts 25 of the hook member 20 rearward upon insertion of the tongue plate 2, a pair of left and right pushing parts 44 for pushing the release button 50 forward upon detachment of the tongue plate 2, a spring connection part 46 to which the front end part of the coil spring 71 is connected, and others. The ejector 40 is arranged to be movable in the forward and rearward directions on the base plate part 11 of the frame 10 and is guided without moving upward with the pair of guided parts 42 by being engaged with the both side edges of the rectangular hole 11*b*.

The front end of the coil spring 71 is inserted into and connected to the spring connection part 46 and the rear end of the coil spring 71 is connected to the spring connection part (not shown) of the base plate part 11; thus the ejector 40 is elastically urged by the urging force of the coil spring 71 in the forward direction (i.e., the detachment direction of the tongue plate 2) with respect to the frame 10.

Now referring to the release button 50, as shown in FIGS. 18 to 20, the release button 50 comprises: a front end wall part 51 at its front end, a pair of left and right guide wall parts 52, and a upper end wall part 53 at its upper end. The pair of guide wall parts 52 are closely placed to the outer sides of the pair of side plate parts 12 of the frame 10 respectively and are formed with a pair of guide grooves 54 which guide the both ends of the lock bar 30 making it movable in forward and rearward directions, the both ends of the lock bar 30 projecting outward from the pair of long holes 12*a* respectively.

When the release button 50 is in an advance limit position (positions shown in FIGS. 19 and 20), the front ends of the guide grooves 54 are located slightly behind the front end of the long hole 12*a*. Each guide wall part 52 is formed with a receiving part 55 which is formed at the front edge of the guide groove 54 and is intended to receive the end part of the lock bar 30 when it moves from the second position to the first position. The foregoing pair of the receiving parts 55, which are formed on the pair of guide wall parts 52, constitute a stop restricting part which is integrally formed with the release button 50 and is intended to receive the lock bar 3 against the urging force of the coil spring 70 when the lock bar 30 is moved to the first position by the urging force.

A pair of left and right slits 56 are formed on the upper wall part 53 of the release button 50 to allow for the forward and rearward motion of the release button 50 with respect to a pair of stopper parts 12*c* of the pair of side plate parts 12 of the frame 10. When the lock bar 30 is moved from the second position to the first position by the urging force of the coil spring 70 and is received by the pair of receiving parts 55 upon insertion of the tongue plate 2, a pair of engaged parts 57 at the rear end of the pair of slits 56 are locked by a pair of stopper parts 12*c* respectively thereby causing the release button 50 to stop at an advance limit position.

A pair of pushed parts 58, which are to be pushed forward in abutment with a pair of pushing parts 44 of the ejector 40 upon detachment of the tongue plate 2 from the buckle body 5, are formed on the inner surface of the front end wall part 51 of the release button 50 and, when detaching the tongue plate 2 from the buckle body 5, the ejector 40, which is urged by the urging force of the coil spring 71, pushes forward (in the direction of tongue plate detachment) the release button 50 together with the tongue plate 2 thereby causing the release button 50 to return to an advance limit position, and then the ejector 40 stops. Even in this state, the ejector 40 stops leaving a certain amount of clearance from the front end of the rectangular hole 11*b* which is formed on the frame 10 so as to push the release button 50 forward by receiving the urging force of the coil spring 71.

Now the lock lever 100 will be described.

As shown in FIGS. 18 to 21, the lock lever 100 includes a base part 101 which is arranged between a pair of side plate rear parts 13 of the frame 10 and is shaped like a lateral axis with a oval shape cross section, and a pair of lever parts 102 which extend nearly forward from the right and left end parts of the base part 101. The base part 101 is formed with a lateral pivot hole 101*a* at an off-centered position from the center of gravity of the lock lever 100, and an axial member 104 is passed through and fixed to the pivot hole 101*a* as a pivot part. And both ends of the axial member 104 are passed through a pair of axial holes 13*a* and thereby the lock lever 100 is pivotably supported on the pair of the side plate rear parts 13 through the axial member 104. Moreover, a notched part 101*b* is formed on the front end part of the base part 101 to avoid interference with the spring receiving part 26 of the hook member 20.

A pair of holding parts 102*a* are formed on the front end lower parts of the pair of right and left lever parts 102, and the front end parts of the lever parts 102, including the holding parts 102*a*, are placed higher than the long holes 12*a*. The lever parts 102 can pivot between a non-lock position (see FIGS. 21 and 22), in which the hook member 20 in engagement with the tongue plate 2 is disengageable (disengagement is allowed), and a lock position (see FIGS. 23 and 24), in which the hook member 20 is locked to be non-disengageable by having the holding part 102*a* abut with the rear inclined surface part of the restricting part 22 of the hook member 20 in engagement with the tongue plate 2.

A spring mounting part 103 is formed on the rear end part of the left lever part 102, and one end of the torsion spring 105, of which the other end is attached to the spring mounting part 13*b* of the side plate rear part 13, is attached to the spring mounting part 103. The lock lever 100 is urged upward to the non-lock position side all the time. And, in a normal state in which the pretensioner is not in operation, the lock lever 100 stays in the non-lock position.

Figure 23:
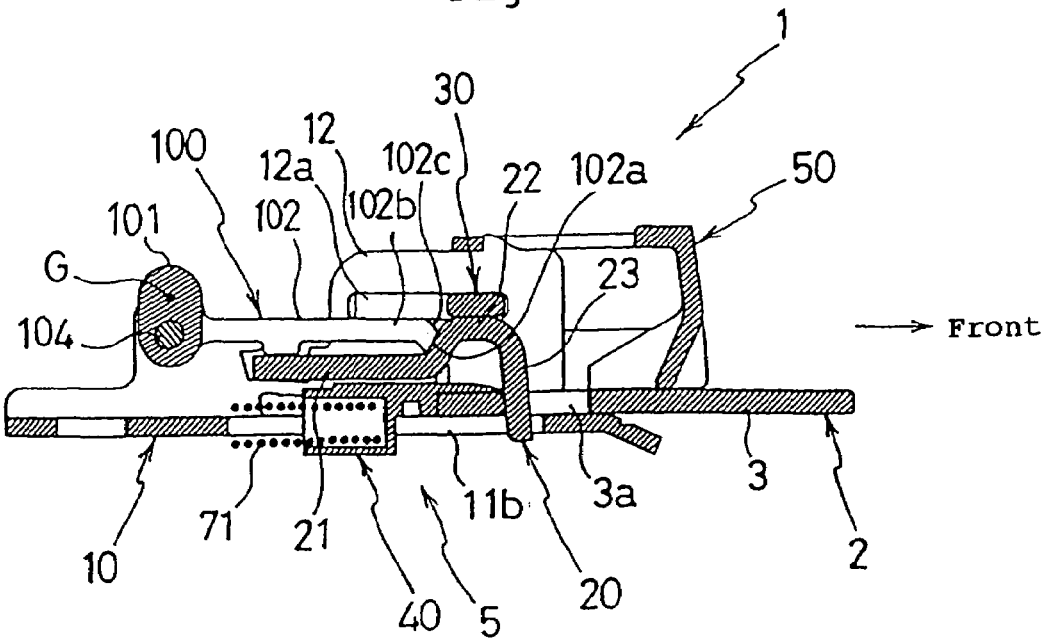
FIG. 23 is a longitudinally sectioned side view showing the buckle device (just after the buckle body started moving) according to the third invention of the present application.
Figure 24:
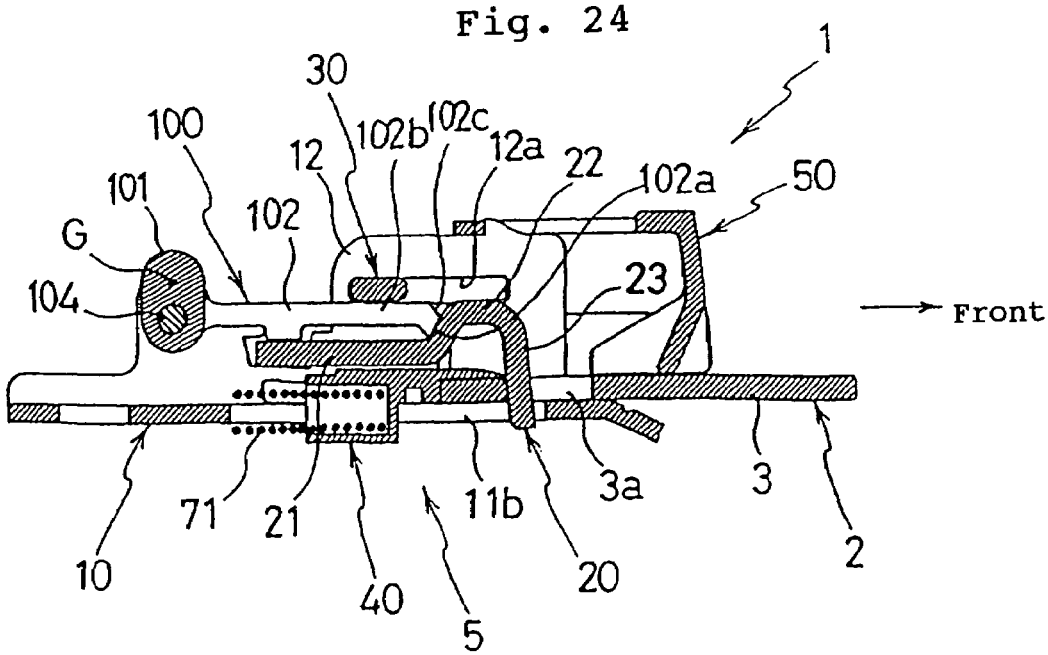
FIG. 24 is a longitudinally sectioned side view showing the buckle device (the buckle body has abruptly stopped) according to the third invention of the present application.

As shown in FIGS. 23 and 24, when the lock lever 100 is in the lock position, most of the upper surface part of the lever part 102 except the front end part is positioned horizontally at a level nearly same as that of the upper surface of the restricting part 22 of the hook member 20, and the front end part of the upper surface is formed with a contact part 102*b* which can contact with the lock bar 30. Also an inclined guiding part 102*c*, which inclines downward in the forward direction from the front end of the contact part 102*b*, is formed in the front end part of the lever part 102.

When the buckle body 5 moves backward upon operation of the pretensioner, an inertial force acts on the buckle body 5 (lock lever 100) in the forward direction; therefore, as shown in FIGS. 20 to 24, the center of gravity of the lock lever 100 is positioned above the axial member 104 so that the lock lever 100 is caused to pivot toward the lock position by the inertial force acting on the center of gravity of the lock lever 100.

Moreover, as described above, the connecting member 73 is fixed to the frame 10 with a rivet 72, and as shown in FIGS. 18 to 20, the frame 10 is assembled with the hook member 20, the lock bar 30, the ejector 40, the release button 50, the lock lever 100, the coil springs 70, 71, and the like. These parts are assembled so as to be contained inside the base cover 74 and the lid cover 75, and the base cover 74 and the lid cover 75 are fixedly integrated through a plurality of fitting parts and engaging parts. The front end of the release button 50 faces out at the front end of the buckle device 1, and the release button 50 is configured to be operable by depressing the front end part of the release button 50 with a finger.

Next, the functions and advantages of the above described buckle device 1 will be explained.

Figure 22:
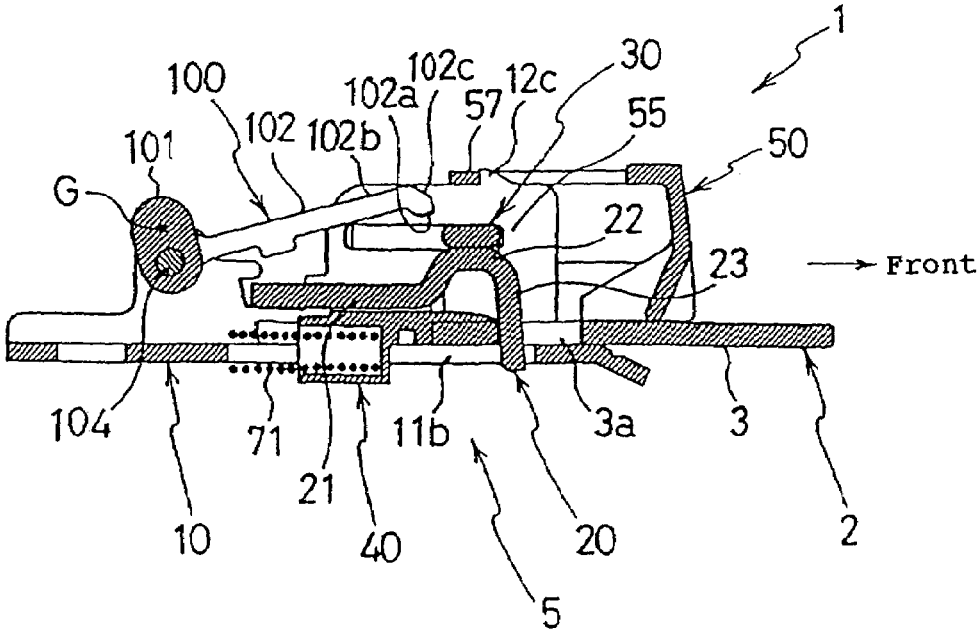
FIG. 22 is a longitudinally sectioned side view showing the buckle device (the tongue plate is being inserted) according to the third invention of the present application.

FIG. 22 shows an engaged state in which the tongue part 3 of the tongue plate 2 is inserted in the buckle body 5 thus bringing the tongue plate 2 and the hook member 20 into engagement. In this engaged state, the hook part 23 engages in the engaging hole 3*a* of the tongue part 3 and in the rectangular hole 11*b* of the frame 10 thereby locking the tongue part 3.

The lock bar 30 is positioned in a first position in abutment with the upper surface of the restricting part 22 of the hook member 20 thereby restricting the pivoting of the hook member 20 in the disengaging direction. A pair of engaged parts 57 of the release button 50 are locked by the pair of stopper parts 12*c* respectively and the release button 50 rests in the advance limit position. In this engaged state, the both ends of the lock bar 30 abut with the pair of receiving parts 55 of the release button 50 and thereby the release button 50 is urged forward by the lock bar 30 which is subjected to the urging force of the coil spring 70.

When detaching the tongue plate 2 from the buckle device 5, moving the release button 50 rearward by pushing it with a finger against the urging force of the coil spring 70 causes the pair of receiving parts 55 of the release button 50 to push the both right and left ends of the lock bar 30 rearward, and thereby the lock bar 30 is moved to the second position together with the release button 50 thereby compressing the coil spring 70, and this causes the hook member 20 to pivot in the disengaging direction via the spring receiving part 26 of the hook member 20. Then, as shown in FIG. 21, in a state in which the lock bar 30 has reached the second position, the lock bar 30 is moved rearward further than the restricting part 22 thus coming out of abutment with the restricting part 22 so that the hook member pivots upward to the limit thereby coming into a disengaged state.

In this disengaged state, the tongue plate 2 is to be detached from the buckle body 5 in the forward direction, and at this time, since the front end of the ejector 40 abuts with the rear end of the tongue plate 2, the tongue plate 2 is urged forward to be detached. And since a pair of pushing parts 44 of the ejector 40 abut a pair of pushed parts 58 of the release button 50, when the finger is removed from the release button 50, the release button 50 is urged forward by the ejector 40, which is urged by the urging force of the coil spring 71, thus returning to the advance limit position.

Figure 21:
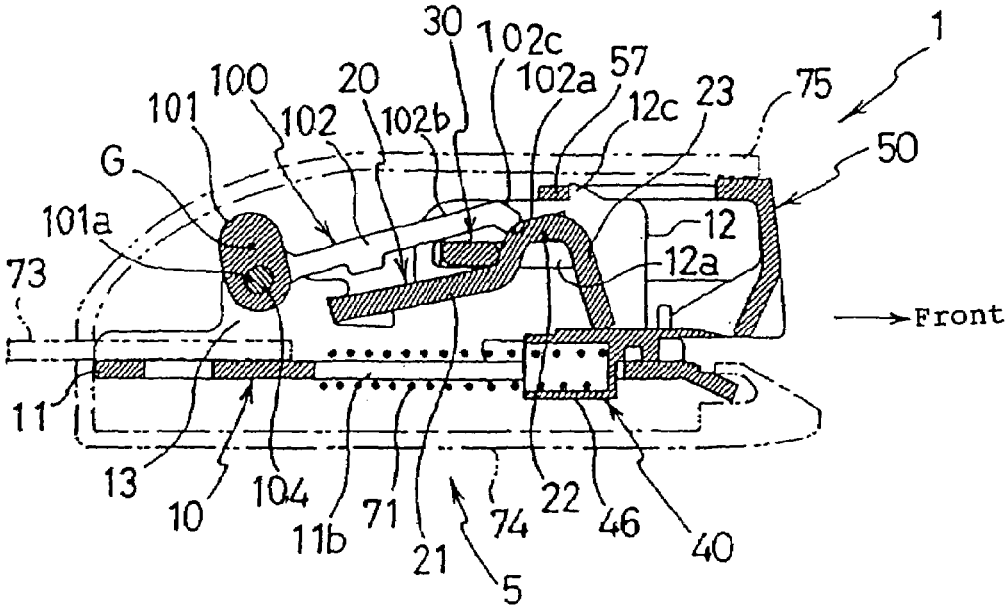
FIG. 21 is a longitudinally sectioned side view showing the buckle device (the tongue plate is not inserted) according to the third invention of the present application.

Next, in a detached state of the tongue plate in FIG. 21, when inserting the tongue plate 2 into the buckle body 5 to connect them together, the tongue part 3 of the tongue plate 2 is inserted from an insert port 6 and brought into abutment with the front end of the ejector 40. And as keep on pushing the ejector 40 by further inserting the tongue plate against the urging force of the coil spring 61, since the pair of the operating parts 43 at the rear end of the ejector 40 abut the pair of operated parts 25 of the hook member 20 thereby causing it to pivot rearward, as shown in FIG. 22, the hook member 20 pivots in the engaging direction against the urging force of the coil spring 70 thus coming into engagement with the engagement hole 3*a* of the tongue part 3 and the lock bar 30 is moved forward from the second position to the first position.

In a normal state in which the pretensioner is not in operation, the lock lever 100 is urged toward the non-lock position of FIGS. 21 and 22 all the time by the torsion spring 105 without being involved in the insertion and extraction operations of the tongue plate 2. On the other hand, in an emergency of the vehicle such as a vehicle collision, the pretensioner comes into operation, and the buckle body 5 is retracted by a predetermined amount in the tightening direction of the webbing thereby restraining the occupant firmly by the webbing. At the same time, in the buckle device 1, the lock lever 100 and the like operate to prevent the tongue plate 2 from being detached from the buckle body 5.

Upon operation of the pretensioner, the buckle body 5 is retracted in the tightening direction of the webbing, i.e., rearward direction and then stops abruptly. At this time, first, the lock lever 100 undergoes an inertial force in the forward direction just after the buckle body 5 starts moving rearward. As shown in FIG. 22, since the center of gravity G of the lock lever 100 is positioned higher then the axial member 104, the inertial force which acts on the center of gravity G acts as a pivot force to cause the lock lever 100 to pivot to the lock position, and thus as shown in FIG. 23, the pair of holding parts 102*a* of the lock lever 100 abuts the rear inclined surface part of the restricting part 22 of the hook member 20.

Subsequently, when the buckle body stops abruptly, the lock bar 30 undergoes an inertial force in the rearward direction. The inertial force acts fully as a force to move the lock bar 30 to the second position, and before the lock lever 100 pivots from the lock position to the non-lock position, as shown in FIG. 24, the lock bar 30 is moved from the first position to the second position against the urging force of the coil spring 70 by the inertial force which acts on the lock bar 30 upon an abrupt stop of the buckle body 5. And after moving to the second position, the lock bar comes into contact with the contact part 102*b* of the lock lever 100 and holds the lock lever 100 in the lock position and thereby the pivoting of the lock lever 100 from the lock position to the non-lock position is inhibited.

After operation of the pretensioner, the lock bar 30 is returned from the second position to the first position by the urging force of the coil spring 70, and thereby the lock lever 100 is urged to pivot from the lock position to the non-lock position by the torsion spring 105 getting back to a normal state, and the occupant can insert and extract the tongue plate 100 into and from the buckle body 5 freely.

As described above, if the lock lever 100 is not provided, upon an abrupt stop of the buckle body 5, the lock bar 30 undergoes an inertial force in the rearward direction thereby moving from the first position to the second position, and the hook member 20 becomes disengaged from the tongue plate 2, thus the tongue plate 2 may be detached from the buckle body 5. But by providing a lock lever 100, the lock bar 30 inhibits the pivoting of the lock lever 100 from the lock position to the non-lock position, thereby detachment of the tongue plate 2 from the buckle body 5 is reliably prevented.

In addition, a simple structure formed of a lock lever 100 and others can successfully prevent the detachment of the tongue plate 2 from the buckle body 5 caused by operation of the pretensioner; this brings about benefits in production cost. Moreover, although the lock bar 30 is moved to the second position urged by an inertial force upon an abrupt stop of the buckle body 5, the lock bar 3 can be received resiliently by the coil spring 70, the lock bar 30 and the likes maintain their normal functions without being broken or deformed.

As the result of forming a contact part 102*b*, which contacts with the lock bar 30 thereby holding the lock laver 100 in the lock position when it moves to the second position upon abrupt stop of the buckle body 5, on the tip part of the lever part 102 of the lock lever 100, it is made possible to securely hold the lock lever 100 in the lock position thereby restraining the lock lever 100 from pivoting toward the non-lock position.

Since the lever part 102 of the lock lever 100 has an inclined guiding part 102*c* which is urged to pivot toward the non-lock position by the lock bar 30 which is moving to the second position, when the lock lever 100 is to move from the non-lock position to the lock position or when the pivoting of the lock lever 100 toward the lock position is delayed when the buckle body 5 starts moving, the lock bar 30, which moves to the second position, comes into contact with the inclined guiding part 102*c*, and thereby the lock lever 100 undergoes an urging force to pivot toward the lock position, and thus it is made possible to forcibly make the lock lever 100 pivot to and hold on the lock position.

Moreover, upon an abrupt stop of the buckle body 5 if, at worst, the lock bar 30 collides with the tip part of the lock lever 100, since the lock bar 30 is positioned in the first position at that time, the lock bar 30 in the first position can prevent the hook member 20 from pivoting and getting disengaged from the tongue plate 2.

Next, buckle device A of another embodiment in which the lock lever 100 of the above described buckle device 1 is modified, will be described. The same parts as those of the above described embodiment are referenced by same numbers and explanations on them will be omitted.

As shown in FIGS. 25 to 28, the lock lever 100A of the buckle device 1A includes a first lever 80 and a second lever 85 which are rotatable about a common axis.

The second lever 85 has a base part 86 and a pair of lever parts 87, and the base part 86 is formed with a pivot hole 86*a* in a lateral direction at a position which is off-centered from the center of gravity of the second lever 85, and an axial member 104 is passed through and fixed to the pivot hole as a pivot part. The rear end part of the first lever 80 is pivatably supported, for example, by the axial member 104, and the first lever 80 and the second lever 85 are independently pivotable about a common axis.

The lever part 87 of the second lever 85 is formed with a holding part 87*a*, a contact part 87*b*, and an inclined guiding part 87*c*, and the second lever 85 has its front end part including the holding part 87*a* at a position higher than the long hole 12*a* and is pivotable between a non-lock position (see FIGS. 25 and 26) in which the hook member 20 in engagement with the tongue plate 2 can be disengaged and a lock position (see FIGS. 27 and 28) in which the holding part 87*a* abuts with the front end upper surface of the body part 21 of the hook member 20 in engagement with the tongue plate 2, and locks the hook member 20 inhibiting disengagement.

The first lever 80 is formed with a pushing part 80*a* which may abut with the upper surface of the second lever 85, and the first lever 80 is pivotable to the lock position together with second lever 85 or independently. And the first lever 80 and the second lever 85 are urged toward the non-lock position by urging members (not shown) respectively. In this regard, it is sufficient if at least the second lever 85 is urged toward the non-lock position by an urging member all the time.

When the buckle body 5 moves rearward upon operation of the pretensioner, an inertial force acts on the lock lever 100A in the forward direction. The center of gravity G1 of the first lever 80 is positioned above the axial member 104 so that the first lever 80 is caused to pivot toward the lock position by the inertial force acting on the center of gravity G1 of the first lever 80, and the center of gravity G2 of the second lever 85 is positioned below the axial member 104 so that the second lever is caused to pivot toward the non-lock position by the inertial force acting on the center of gravity G2 of the second lever 85.

The masses and the centers of the gravity G1, G2, and the likes are configured so that the pivotal force to urge the first lever 80 to pivot toward the lock position due to the inertial force acting on the first lever 80 is larger than the pivotal force to urge the second lever 85 to pivot toward the non-lock position due to the inertial force acting on the second lever 85.

The functions and advantages of the buckle device 1A will be described below.

Figure 25:
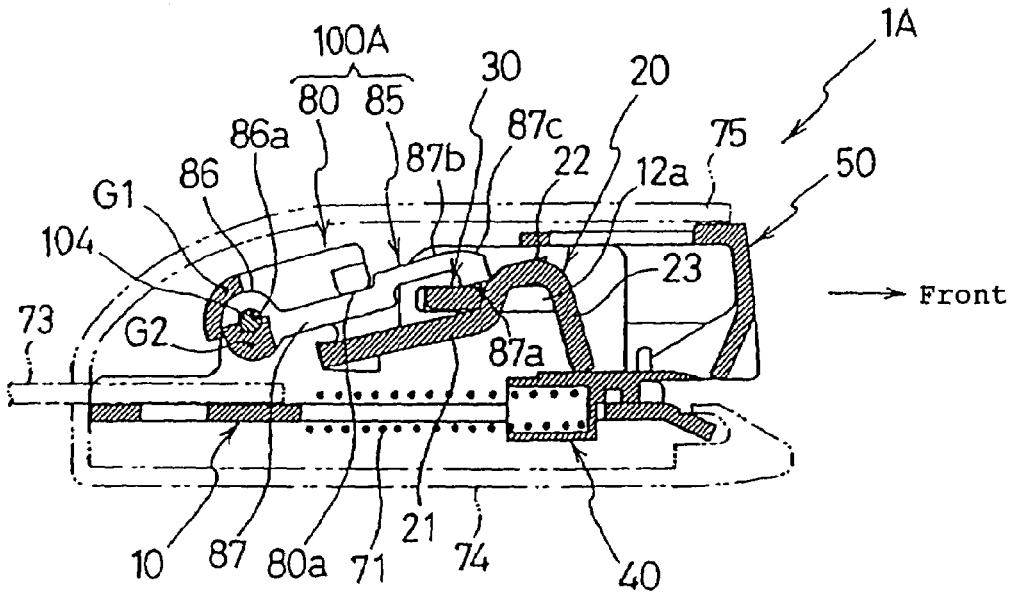
FIG. 25 is a longitudinally sectioned side view showing the buckle device relating to another embodiment of the third invention of the present application.
Figure 26:
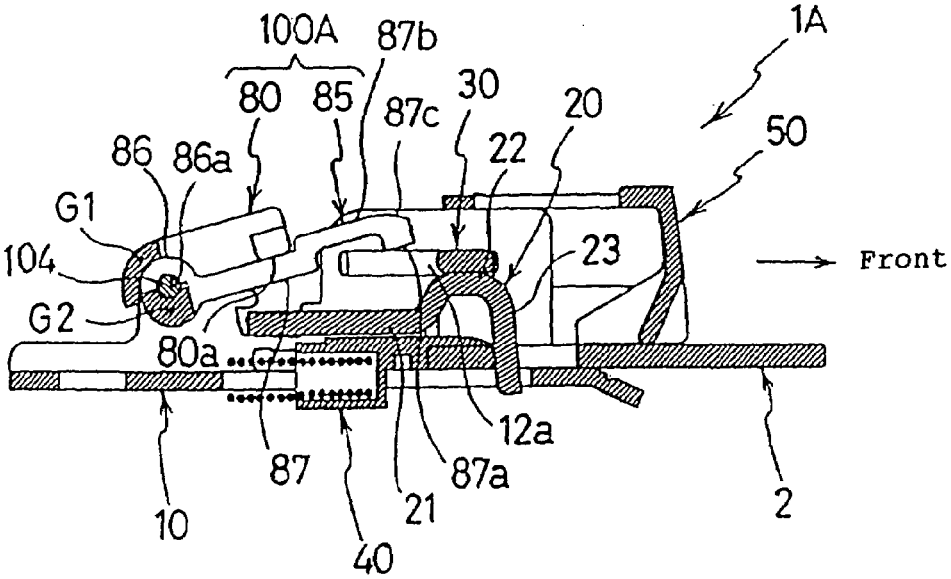
FIG. 26 is a longitudinally sectioned side view showing the buckle device (the tongue plate is being inserted) according to the third invention of the present application.

FIG. 25 shows a state in which the tongue plate 2 is being detached from the buckle body 5, and FIG. 26 shows a state in which the tongue plate 2 is being inserted into the buckle body 5. In a normal state in which the pretensioner is not in operation, the first and second levers 80, 85 of the lock lever 100A are urged toward the non-lock position all the time.

In an emergency of the vehicle such as a vehicle collision, the pretensioner operates and the buckle body 5 is retracted backward and then stops abruptly. In this situation, first the lock lever 10A undergoes a forward direction inertial force just after the buckle body starts moving backward. As shown in FIG. 26, since the center of gravity G1 of the first lever 80 is positioned above the axial member 104, the inertial force which acts on the gravity center G1 acts as a pivotal force to urge the first lever to pivot toward the lock position.

Figure 27:
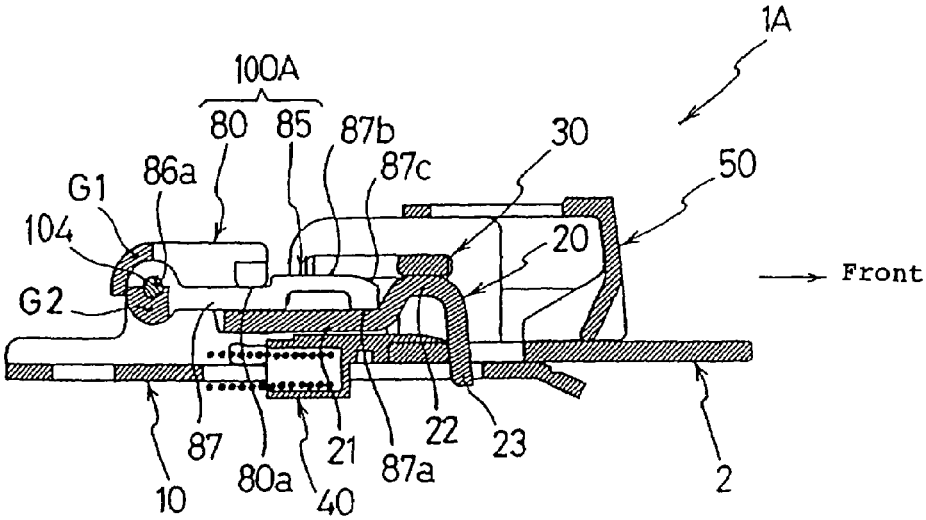
FIG. 27 is a longitudinally sectioned side view showing the buckle device (immediately after the buckle body has started moving) according to the third invention of the present application.

On the other hand, since the center of gravity G2 of the second lever 85 is positioned below the axial member 104, the inertial force which acts on the center of gravity G2 acts as a pivotal force to urge the second lever 85 to pivot toward the non-lock position. As described before, since the pivotal force of the first lever 80 toward the lock position side is arranged to be larger than the pivotal force of the second lever 85 toward the non-lock position side, as shown in FIG. 27, the second lever 85 pivots to the lock position by being pushed by the pushing part 80*a* of the first lever 80 which pivots urged by an inertial force, and a pair of holding parts 87*a* come into abutment with the front end upper surface of the body part 21 of the hook member 20.

Figure 28:
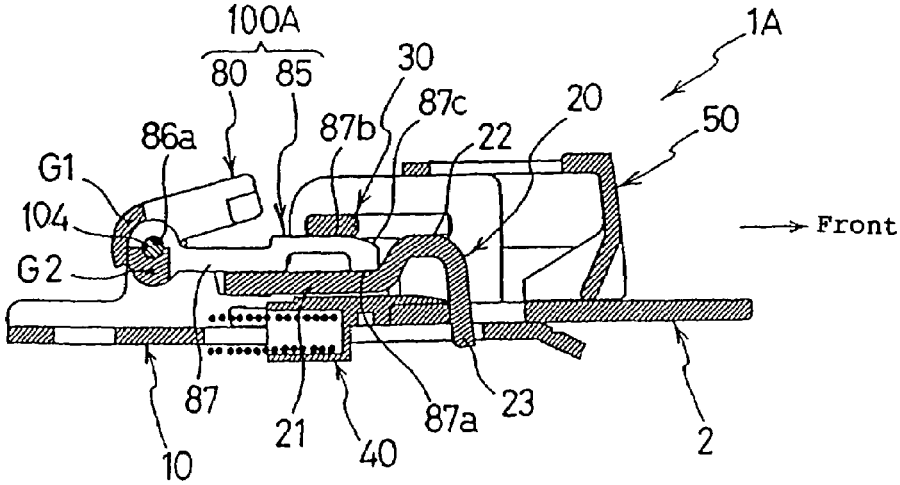
FIG. 28 is a longitudinally sectioned side view showing the buckle device (the buckle body has abruptly stopped) according to the third invention of the present application.

Subsequently, upon an abrupt stop of the buckle body 5, the lock bar 30 undergoes an inertial force in the rearward direction, and as shown in FIG. 28, is moved from the first position to the second position against the urging force of coil spring 70 before the second lock lever 85 has not pivoted to the non-lock position. At this time, since the inertial force which acts on the center of gravity G2 of the second layer 85 acts as a force to hold the second lever 85 in the lock position, the second lever 85 is held in the lock position due to the inertial force, and the lock bar 30 which has moved to the second position comes into contact securely with the contact part 87*b* of the second lever 85 thereby holding the second lever 85 in the lock position. In this regard, although the first lever 80 pivots to the non-lock position urged by the inertial force when the buckle body 5 stops abruptly, but there will be no problem.

Thus, the lock lever 100A comprises a first lever 80 and a second lever 85 which are rotatable about a common axis. Upon operation of the pretensioner, the second lever 85 pivots to the lock position by being pushed by the first lever 80 which pivots due to an inertial force just after the buckle body 5 has started moving, thus the second lock lever 85 can be held in the lock position when the buckle body 5 stops abruptly. Therefore, when the buckle body stops abruptly, the lock bar 30 moves to the second position and thus the pivoting of the second lever 85 from the lock position to the non-lock position is inhibited more securely preventing the detachment of the tongue plate 2 from the buckle body 5. In addition, functions and advantages similar to those of the previously described embodiments are to be expected.

The above described buckle devices 1, 1A are shown by way of explanation and the present invention can be implemented by giving various modifications to each part without departing from the scope of the invention.

INDUSTRIAL APPLICABILITY

In the buckle device according to the first invention of the present application, as described so far, a stop restriction part, which receives the lock bar against the urging force of the biasing member when the lock bar is moved to the first position by the urging force upon insertion of the tongue plate, is integrally formed with a release button which is made of plastics; this allows the lock bar to be received by a stop restriction part made of plastics when it is switched from the second position to the first position without producing impact noise between a couple of metal members, and only lower and milder impact noise compared to that of metal members is produced.

In the above described buckle device, if the spring member to urge the ejector is exploited to push the release button in the disengaging direction of the tongue plate when detaching the tongue plate, it becomes possible to eliminate the spring member for pushing the release button in the disengaging direction of the tongue plate, and also to eliminate a pair of the spring receiving parts for receiving the both ends of the spring member, thereby reducing the number of the parts, simplifying the structure, and also simplifying assembly of the buckle device. Moreover, since the release button is urged by the spring member all the time when the tongue plate is in disengaged state, no unusual noises due to looseness are produced as well as the standby state is stabilized.

Furthermore, in the above described buckle device, if the lock bar pass is passed through a pair of long holes formed on a pair of side plate parts of the frame and mounted across a pair of side plate parts, the support for the both ends of the lock bar is stabilized and also it becomes possible to securely inhibit pivoting of the hook member in the disengaging direction while the lock bar is in the first position. Further, since the foregoing stop restraining part consists of a pair of receiving parts for receiving the both ends of the lock bar projecting outward from the pair of side plate parts, the stability of operation for receiving the lock bar into the first position is secured.

Furthermore, in the above described buckle device, if a stopper part, which locks the release button against the urging force of the foregoing biasing member urging the forgoing lock bar, integrally with the frame, it becomes possible to lock the release button by the stopper part integrally formed on the metal frame even when a force in the disengaging direction is exerted on the release button by the lock bar upon insertion of the tongue plate, and it is also possible to produce the stopper part readily at low cost since it is integrally formed with the frame.

Furthermore, in the above mentioned buckle device, if the lock bar is formed of a strip-type member and the both ends of lock bar are made to pass through a pair of long holes and are guided by a pair of guide grooves, it becomes possible to guide the release button movably with the both ends of the lock bar through a pair of guide grooves. That is, by means of a pair of guide wall parts and guide grooves thereof, it is possible to restrain the lock bar from moving in its longitudinal direction and thereby inhibiting detachment of the lock bar from the pair of long holes. Thus, by means of the frame, the pair of long holes thereof, and the lock bar, it is possible to restrain the release button from coming off the lock bar thereby restricting the movable directions of the release button through a pair of guide wall parts and a pair of guide grooves thereof. Thus, the structures concerning the lock bar and the release button are drastically simplified.

Furthermore, in the above described buckle device, if each guide groove is formed of a groove of which both ends are closed, and each guide wall part is provided with an import opening to introduce the ends of the lock bar into intermediate part of the length of the guide groove from a direction perpendicular to the guide groove, it becomes possible to assemble the release button easily by introducing the end of the lock bar into intermediate part of the length of the guide groove through the import port. In addition, if the import opening is formed in an appropriate position which does not correspond to the positions of the lock bar when it is in the first position or the second position, it is possible to minimize the possibility that the ends of the lock bar comes off the import opening.

Next, according to the second invention of the present application, when the tongue plate is being inserted in the buckle body, the first position side end part of the lock bar abuts with the first engaging part causing the lock member to pivot to the lock position and holds the lock member in the lock position, and the second engaging part protrudes into the movable area of the lock bar closely facing it, therefore it is possible to inhibit the lock bar from moving to second position by having it received by the second engaging part even if the lock bar starts moving to the second position due to an inertial force in an emergency of the vehicle. This makes it possible to prevent detachment of the tongue plate from the buckle body due to disengagement of the hook member.

Further, in a normal condition other than an emergency of the vehicle, the second engaging part only abuts with the lock bar upon insertion of the tongue plate and does not affect the insertion and extraction operations of the tongue plate, thus smooth and reliable insertion and extraction operations of the tongue plate are achieved. Moreover, a mechanism to prevent detachment of the tongue plate from the buckle body in an emergency of the vehicle is achieved by a simple structure consisting of a lock bar and a biasing member, and therefore the production cost is advantageously reduced. Also, upon insertion of the tongue plate, the lock bar, which moves to the first position by an urging force, can be resiliently received via the first engaging part, and thus the first engaging part acts as a cushion thereby effectively reducing the contacting noises of the lock bar.

In the above described buckle device, even when the release button of the buckle device is depressed by being accidentally hit by the occupant's hand or elbow due to a sudden change in the posture of the occupant, thereby causing a rapid motion of the lock bar, due to the delay in operation of the lock member, the lock bar will restrain the pivot of the hook member thereby preventing the disengagement of the hook member and the tongue plate, and thus a buckle device with utmost safety is achieved. Also it is possible to freely layout the appearance of the buckle device.

In the above described buckle device, if the base end part of the lock member is pivotally mounted on the frame at a location spaced away from the plane including the movable area of the lock bar in the direction opposite the hook member, this will cause the first engaging part to be pushed by the first position side end part of the lock bar which is moving to the first position, and thus it becomes possible to make the lock member to pivot to the lock position securely maintaining its lock position Moreover, according to the second invention of the present application, in a normal condition in which the pretensioner is not in operation, when the tongue plate is being inserted in the buckle body, the first engaging part abuts with the first position side end part of the lock bar and causes the lock member to pivot to the lock position, and the second engaging part protrudes into the movable area of the lock bar, therefore even if the lock bar starts moving to the second position by an inertial force acting on it upon a sudden stop of the buckle body after operation of the pretensioner, the lock bar is received by the second engaging part which protrudes into the movable area of the lock bar thereby inhibiting the movement of the lock bar to the second position, and thus it is made possible to securely restrain the tongue plate from getting detached from the buckle body. In addition to this, similar advantages as those of the above described buckle device are to be expected.

Further, in the second invention of the present application, if the lock member is pivotably mounted on the frame through a pivot part whose center is off the center of gravity of the lock member so that an inertial force acts on the lock member will urge it to pivot to the lock position upon a sudden stop of the buckle body after operation of the pretensionerit, it becomes possible to securely receive the lock bar, which has started moving to the second position, with the second engaging part.

Further more, in the second invention of the present application, if the second engaging part of the lock member is configured to exert a pivoting force on the lock member to pivot to the lock position by contacting with the lock bar which is moving to the second position side, it becomes possible to make the lock member pivot to the lock position securely when the lock bar, which has started to move to the second position, comes into contact with the second engaging part even in a state in which the second engaging part of the lock member has not fully intervened into the movable area of the lock bar. That is, it is possible to make the second engaging part fully intervene into the movable area of the lock bar and to receive the lock bar securely with the second engaging part.

Next, according to the buckle device of third invention of the present application, there is provided a lock lever, which can pivot over the range between a lock position to inhibit the disengagement of the hook member which is in engagement with the tongue plate and a non-lock position to allow the disengagement and is urged to the non-lock position all the time. In this configuration, since the lock lever is pivotably mounted on the frame via a pivot part of which center is off the center of gravity of the lock lever, upon operation of the pretensioner, the lock lever will pivot to the lock position urged by an inertial force just after the buckle body starts moving, and the lock bar will move to the second position urged by an inertial force when the buckle body abruptly stops, and thus it is possible to restrain the lock lever from pivoting from the lock position to the non-lock position.

That is, if the lock lever is not provided, the lock bar will move from the first position to the second position urged by an inertial force upon a sudden stop of the buckle body, and the hook member may be disengaged thereby allowing the tongue plate to get detached from the buckle body. In contrast, with the lock lever provided, even when the lock bar moves to the second position, the lock bar restrains the lock lever from pivoting from the lock position to the non-lock position and detachment of the tongue plate from the buckle body can be securely prevented. Moreover, since it is possible to prevent detachment of the tongue plate from the buckle body due to operation of the pretensioner by a simple structure formed of a lock lever and others, the production cost is advantageously reduced. Furthermore, since the lock bar is resiliently received by a biasing member when the lock bar moves to the second position under an inertial force upon a sudden stop of the buckle body, it is possible to make the lock bar and other parts operate normally without being damaged or deformed.

In the above described buckle device, if a contact part is formed in the tip part of the lock lever such that the lock bar which has moved to the second position comes into contact with the contact part to hold the lock lever in the lock position upon a sudden stop of the buckle body, it is possible to securely hold the lock lever in the lock position by means of the lock bar thereby securely inhibiting the pivoting of the lock lever to the non-lock position.

Further, in the above described buckle device, if there is formed a inclined guiding part, which is subject to a pivoting force in the direction of the lock position exerted by the lock bar moving to the second position, since the lock bar moving to the second position comes into contact with the inclined guiding part of the lock lever, and thus the lock lever undergoes a pivot force to the lock position, it is possible to force the lock lever to pivot to and to be held in the lock position.

Further, in the above described buckle device, if the center of gravity of the lock lever is arranged such that the lock lever is urged to pivot to the lock position by an inertial force which acts on the center of gravity of the lock lever when the buckle body moves, it becomes possible to have the lock lever to pivot securely to the lock position by an inertial force which acts just after the buckle body start moving.

Also in the above described buckle device, if an arrangement is made such that the lock lever includes a first lever and a second lever which are pivotable around a common axis, and the second lever pivots to the lock position by being pushed by the first lever, which pivots urged by an inertial force just after the buckle body has started moving upon operation of the pretensioner, and the second lever is held in the lock position side by an inertial force upon an abrupt stop of the buckle body, this will cause the lock bar to move to the second position to restrain more securely the lock lever from pivoting from the lock position to the non-lock position upon an abrupt stop of the buckle body, thereby making it possible to securely prevent detachment of the tongue plate from the buckle body.

What is claimed is:

1. A buckle device (1) comprising a tongue plate (2) to be connected to the webbing, and a buckle body (5) into and from which the tongue plate (2) is inserted and extracted, wherein the buckle body (5) comprises: a frame (10); a hook member (20) pivotably mounted on the frame (10), the hook member being adapted to pivot to come into engagement with the tongue plate (2) upon insertion of the tongue plate (2) and being pivotally urged in the disengaging direction all the time; a release button (50) made of plastic and for releasing the engagement between the hook member (20) and the tongue plate (2); and a lock bar (30) adapted to move to a first position, in which the lock bar inhibits pivoting of the hook member (20) in the disengaging direction, by an urging force of a biasing member when the hook member (20) is engaged with the tongue plate (2), and move to a second position, in which the lock bar allows pivoting of the hook member (2) in the disengagement direction, by being pushed by the release button (50) upon disengaging operation of the release button (50):

said buckle device is provided with a lock member (90) which is mounted on said frame (10) pivotably between a lock position, in which the lock bar (30) is locked in the first position, and a non-lock position in which the lock bar (30) is not locked, and a biasing member for elastically urging the lock member (90) to the non-lock position;

in that the lock member (90) comprises: a base end part (91) pivotally mounted on the frame (10); a first engaging part formed in one end thereof; and a second engaging part (94) faced with the first engaging part (93) and adequately spaced therefrom to allow for receiving the lock bar (30); and in that a first position side end part of the lock bar (30) maintains the lock position abutting with the first engaging part (93), and the second engaging part (94) protruding into the movable area of the lock bar (30) closely faces the lock bar (30), when the lock member (90) is in the lock position.

2. The buckle device according to claim 1, characterized in that the base end part (91) of the lock member (90) is pivotally mounted on the frame (10) at a position away from the plane including the movable area of the lock bar (30) in the direction opposite to the hook member (20).

3. The buckle device according to claim 2, characterized in that the lock member (90) is pivotably mounted on the frame (10) through a pivot part which is off-centered from the center of gravity of the lock bar, and the lock member (90) is adapted to undergo an inertial force urging to pivot toward the lock position upon an abrupt stop of the buckle body (5) after operation of a pretensioner.

4. The buckle device according to claim 2, characterized in that the second engaging part (94) of the lock member (90) is adapted to generate a pivoting force to urge the lock member (90) toward the lock position by coming into contact with the lock bar (30) moving toward the second position.

5. The buckle device according to claim 1, characterized in that the lock member (90) is pivotably mounted on the frame (10) through a pivot part which is off-centered from the center of gravity of the lock bar, and the lock member (90) is adapted to undergo an inertial force urging to pivot toward the lock position upon an abrupt stop of the buckle body (5) after operation of a pretensioner.

6. The buckle device according to claim 1, characterized in that the second engaging part (94) of the lock member (90) is adapted to generate a pivoting force to urge the lock member (90) toward the lock position by coming into contact with the lock bar (30) moving toward the second position.

7. A buckle device (1), comprising a tongue plate (2) to be connected to a webbing, and a buckle body (5) into and from which the tongue plate (2) is inserted and extracted, and equipped with a pretensioner for retracting the buckle body (5) in the tightening direction to tighten the webbing in an emergency of the vehicle, wherein said buckle body (5) comprises: a frame (10); a hook member (20) pivotably mounted on the frame (10), the hook member being adapted to pivot to come into engagement with the tongue plate (2) upon insertion of the tongue plate (2) and being pivotally urged in the disengaging direction all the time; a release button (50) made of plastic and for releasing the engagement member between the hook member (20) and the tongue plate (2); and a lock bar (30) adapted to move to a first position, in which the lock bar inhibits pivoting of the hook member (20) in the disengaging direction, by an urging force of a biasing member when the hook member is engaged with the tongue plate (2), and move to a second position, in which the lock bar allows pivoting of the hook member (20) in the disengagement direction, by being pushed by the release button (50) upon disengaging operation of the release button (50):

said buckle device is provided with a lock member (90) mounted on said frame (10) pivotably between a lock position, in which the lock bar (30) resting in a first position is inhibited from moving to a second position, and a non-lock position in which the lock bar (30) is not inhibited from moving, and a biasing member to elastically urge the lock member (90) to the non-lock position, the lock member (90) having a first engaging part (93) with which a first position side end part of the lock bar (30) can abut, and a second engaging part (94) adapted to protrude into the movable area of the lock bar (30) to abut with a second position side end part of the lock bar (30) when it is in the lock position, and in that when the pretensioner is and is not in operation, the lock bar (30), which is urged to the first position, is adapted to abut against the first engaging part (93) thereby causing the lock member (90) to pivot to the lock position, and thus the second engaging part (94) is adapted to receive the lock bar (30), which has started to move to the second position side urged by an inertial force due to abrupt stop of the buckle body (5) after operation of the pretensioner, thereby inhibiting the lock bar (30) from moving to the second position.

8. The buckle device according to claim 7, characterized in that the lock member (90) is pivotably mounted on the frame (10) through a pivot part which is off-centered from the center of gravity of the lock bar, and the lock member (90) is adapted to undergo an inertial force urging to pivot toward the lock position upon an abrupt stop of the buckle body (5) after operation of the pretensioner.

9. The buckle device according to claim 8, characterized in that the second engaging part (94) of the lock member (90) is adapted to generate a pivoting force to urge the lock member (90) toward the lock position by coming into contact with the lock bar (30) moving toward the second position.

10. The buckle device according to claim 7, characterized in that the second engaging part (94) of the lock member (90) is adapted to generate a pivoting force to urge the lock member (90) toward the lock position by coming into contact with the lock bar (30) moving toward the second position.

* * * * *